US011898745B2

(12) United States Patent
Seth et al.

(10) Patent No.: US 11,898,745 B2
(45) Date of Patent: Feb. 13, 2024

(54) ELECTRICAL VAPOR GENERATION METHODS AND RELATED SYSTEMS

(71) Applicant: InnoTech Alberta Inc., Edmonton (CA)

(72) Inventors: Deepyaman Seth, Edmonton (CA); Cathal Tunney, Edmonton (CA)

(73) Assignee: Innotech Alberta Inc., Edmonton (CA)

( * ) Notice: Subject to any disclaimer, the term of this patent is extended or adjusted under 35 U.S.C. 154(b) by 379 days.

(21) Appl. No.: 17/095,555

(22) Filed: Nov. 11, 2020

(65) Prior Publication Data

US 2021/0140627 A1 May 13, 2021

Related U.S. Application Data

(60) Provisional application No. 62/934,117, filed on Nov. 12, 2019.

(51) Int. Cl.
*F22B 1/28* (2006.01)
*E21B 43/24* (2006.01)

(52) U.S. Cl.
CPC ..... *F22B 1/284* (2013.01); *E21B 43/2401* (2013.01); *E21B 43/2406* (2013.01)

(58) Field of Classification Search
CPC .. F22B 1/284; F22B 1/30; F22B 27/00; F22B 7/00; E21B 43/2401; E21B 43/2406; F22G 1/165
See application file for complete search history.

(56) References Cited

U.S. PATENT DOCUMENTS 2,387,103 A * 10/1945 Wicks ..... F22B 1/30 392/338
2,521,751 A * 9/1950 Sampson ..... F25D 31/00 62/99
3,313,111 A * 4/1967 Strohmeyer, Jr. ..... F22B 29/12 60/656
7,484,561 B2 2/2009 Bridges
9,097,110 B2 8/2015 Kaminsky et al.
9,243,484 B1 * 1/2016 Van Son ..... H04N 21/4668
9,604,864 B2 3/2017 Berros et al.
(Continued)

FOREIGN PATENT DOCUMENTS

CA 2 885 081 A1 9/2015

OTHER PUBLICATIONS

A.M. Assiry, Electrical conductivity of seawater during ohmic heating, Jun. 3, 2010, Elsevier, Desalination 260, pp. 9 and 16 (Year: 2010).*

*Primary Examiner* — Edelmira Bosques
*Assistant Examiner* — Michael James Giordano
(74) *Attorney, Agent, or Firm* — Christensen O'Connor Johnson Kindness PLLC

(57) ABSTRACT

Methods for generating a vapor are provided. In some embodiments, the method may comprise heating a pressurized stream liquid brine in an ohmic heating device and introducing the resulting heated, pressurized stream liquid brine into a flash vessel such that the heated, pressurized liquid brine flashes to a vapor portion and a remaining liquid portion. In some embodiments, the method provides integrated vapor generation and water treatment such that feedwaters of varying water quality may be used. Also provided are related systems for generating a vapor.

19 Claims, 10 Drawing Sheets

(56) References Cited

U.S. PATENT DOCUMENTS

| | | | | |
|---|---|---|---|---|
| 2009/0283396 | A1* | 11/2009 | Bailie | C02F 1/041<br>202/185.1 |
| 2012/0279903 | A1 | 11/2012 | Tsilevich | |
| 2013/0183204 | A1* | 7/2013 | Benipal | C10J 3/84<br>422/310 |
| 2014/0246196 | A1 | 9/2014 | Larkin et al. | |

* cited by examiner

ELECTRICAL VAPOR GENERATION METHODS AND RELATED SYSTEMS

RELATED APPLICATION

The present application claims priority to U.S. Provisional Patent Application No. 62/934,117 filed Nov. 12, 2019, the entire contents of which are incorporated by reference herein.

TECHNICAL FIELD

The present disclosure relates to processes for generating a vapor from a liquid. More particularly, the present disclosure relates to electrical vapor generation methods and related systems.

BACKGROUND

Water is generally abundant and steam, i.e. water in vapor phase, is an effective heat transport fluid. Consequently, steam is used in several thermal heavy oil recovery processes, including the Steam Assisted Gravity Drainage (SAGD), Cyclic Steam Stimulation (CSS) and Steam Flooding processes. These processes typically require the injection of two to six barrels of steam, on a liquid water equivalent basis, to recover one barrel of oil. Therefore, water handling and treatment costs can represent a significant portion of total operating costs and, for new capacity investments, a major share of capital costs as well.

Produced water, comprised primarily of condensed injected steam that is produced back to surface along with mobilized heavy oil, may be recycled to produce new steam for injection. However, treatment of such produced water may be complicated and expensive. High costs and long construction lead times to build new water treatment capacity are particularly challenging for greenfield thermal oil recovery projects. In addition, steam generation may be energy intensive and the conventional natural gas fired boilers typically used in thermal oil recovery operations may result in significant greenhouse gas emissions.

In conventional water-tube boilers, dissolved solids in the boiler feedwater may precipitate out on the heat transfer surfaces, such as the interior walls of the boiler tubes, as water boils and is converted to steam. This "fouling" may first reduce heat transfer efficiency and, if not remediated, can cause equipment failure through plugging-off or localized over-heating and mechanical failure.

Electrical steam generation may be an alternative to conventional steam generation to reduce or eliminate the greenhouse gas emissions typically associated with natural gas fired boilers. Ohmic steam generation, also known as electrode boiler technology, typically involves passing an electric current through pressurized water such that steam is boiled off at the surface of the pressurized water. Ohmic steam generation has the advantage of avoiding heat transfer surfaces and thereby avoiding the fouling issues of conventional water-tube type steam generators. However, within an ohmic steam generator, it may be difficult to control electric arcing above a boiling water surface in the presence of strong electric fields. Therefore, conventional ohmic steam generators typically require high quality boiler feedwater. Indeed, conventional ohmic steam generation may require a significantly higher water quality than what is required for the once-through steam generators often used in thermal oil recovery operations.

SUMMARY

In one aspect, there is provided a method generating a vapor, the method comprising: a) providing a flash vessel operating at a first pressure and a first temperature and having a liquid brine phase therein; b) introducing a feedstream into the flash vessel such that the feedstream enters the liquid brine phase; c) withdrawing a stream of liquid brine from the liquid brine phase of the flash vessel; d) pressurizing the stream of liquid brine to a second pressure, the second pressure being higher than the first pressure; heating the pressurized stream of liquid brine from step d) in an ohmic heating device to a second temperature, the second temperature being higher than the first temperature; f) introducing the pressurized, heated stream of liquid brine from step e) into the flash vessel such that the pressurized, heated stream of liquid brine flashes to a vapor portion and a remaining liquid portion; and g) withdrawing a vapor stream from the flash vessel.

In some embodiments, the method further comprises repeating steps b) to g) continuously or intermittently.

In some embodiments, the method further comprises maintaining the liquid brine phase in the flash vessel at or above a threshold volume.

In some embodiments, the method further comprises repeating steps c) to g) prior to introducing an additional feedstream at step b).

In some embodiments, the method further comprises deaerating the feedstream in a deaerator prior to step b).

In some embodiments, the method further comprises separating the vapor stream into a primary vapor stream and a secondary vapor stream, the secondary vapor stream being at a lower pressure than the primary vapor stream.

In some embodiments, the method further comprises introducing the secondary vapor stream into the deaerator.

In some embodiments, the method further comprises withdrawing, from the flash vessel, a first slurry stream of precipitated solids produced by flashing the pressurized, heated stream of liquid brine at step f).

In some embodiments, the method further comprises providing a secondary flash vessel having a second liquid brine phase therein and operating at a third pressure and a third temperature, the third pressure and the third temperature being lower than the first pressure and first temperature; and introducing the first slurry stream into the secondary flash vessel such that the first slurry stream flashes to a second vapor portion and a second remaining liquid portion.

In some embodiments, the method further comprises withdrawing a second slurry stream from the secondary flash vessel, the second slurry stream comprising precipitated solids produced by flashing the first slurry stream.

In some embodiments, the method further comprises separating the second slurry stream into a sludge stream and a second stream of liquid brine.

In some embodiments, the method further comprises combining the second stream of liquid brine with the feedstream prior to step b).

In some embodiments, the method further comprises withdrawing a second vapor stream from the secondary flash vessel and introducing the second vapor stream into the deaerator.

In some embodiments, the feedstream comprises at least one of a produced water from a thermal oil recovery process, a brackish water, a sea water, or a process water from a chemical, ore, or biomass processing operation In some embodiments, the produced water is minimally treated.

In some embodiments, the method further comprises introducing at least one of a nucleation agent, a coagulation agent, and a flocculation agent into the liquid brine phase in the flash vessel.

In another aspect, there is provided a system for vaporizing a feedstream, comprising: at least one ohmic heating device; and at least one flash vessel in fluid communication with the at least one ohmic heating device, the at least one flash vessel having a liquid brine phase therein.

In some embodiments, the at least one ohmic heating device is operatively connected to at least one power source.

In some embodiments, the at least one power source comprises a variably available power source.

In some embodiments, the variably available power source comprises a low carbon power source.

In some embodiments, the at least one power source comprises a continuously available power source.

In some embodiments, the at least one flash vessel comprises a primary flash vessel and a secondary flash vessel, the secondary flash vessel having a lower operating pressure than the primary flash vessel.

In some embodiments, the system further comprises a feedwater storage vessel operating at atmospheric pressure and a pump in fluid communication with the feedwater storage vessel to pump feedwater to a desired pressure.

In some embodiments, the system further comprises a deaerator in fluid communication with the pump and the at least one flash vessel.

In some embodiments, the at least one ohmic heating device comprises: an outer tubular body; at least one inner tubular body; and an annular space defined therebetween; wherein the annular space receives a pressurized brine therein to complete an electrical heating circuit between the outer tubular body and the at least one inner tubular body.

In some embodiments, the at least one inner tubular body comprises one inner tubular body and the at least one ohmic heating device uses single-phase AC power.

In some embodiments, the at least one inner tubular body comprises three inner tubular bodies and the at least one ohmic heating device uses three-phase AC power.

Other aspects and features of the present disclosure will become apparent, to those ordinarily skilled in the art, upon review of the following description of specific embodiments of the disclosure.

BRIEF DESCRIPTION OF THE DRAWINGS

Some aspects of the disclosure will now be described in greater detail with reference to the accompanying drawings. In the drawings.

DETAILED DESCRIPTION

Figure 1A:
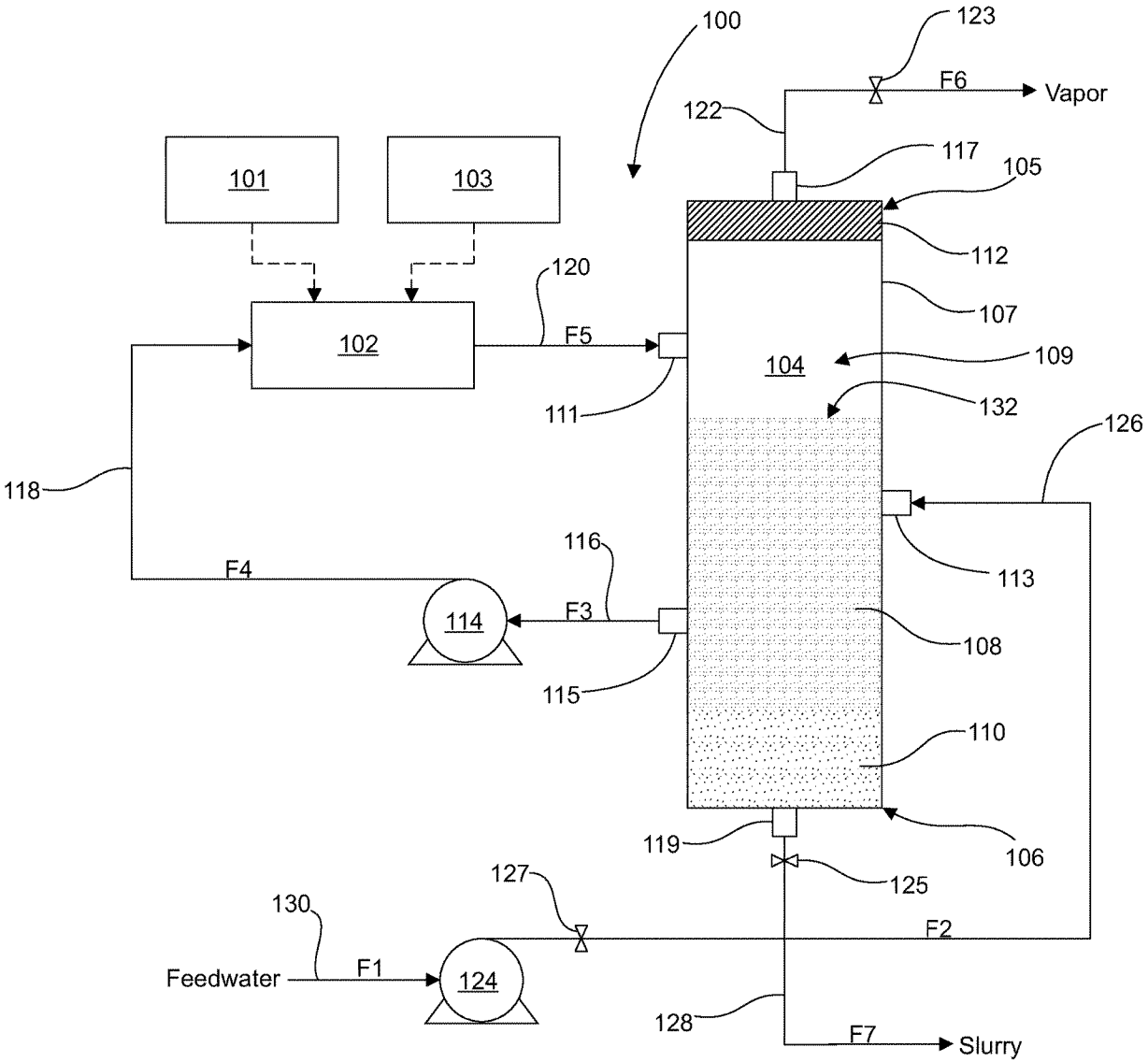
FIG. 1A is a process flow diagram of an example system for generating a vapor, shown in a first configuration, according to some embodiments.

Generally, the present disclosure provides a method for generating a vapor. The method may comprise: a) providing a flash vessel operating at a first temperature and a first pressure and having a liquid brine phase therein; b) introducing a feedstream into the flash vessel such that the feedstream enters the liquid brine phase; c) withdrawing a stream of liquid brine from the liquid brine phase of the flash vessel; d) pressurizing the stream of liquid brine to a second pressure, the second pressure being higher than the first pressure; e) heating the pressurized stream of liquid brine from step d) in an ohmic heating device to a second temperature, the second temperature being higher than the first temperature; f) introducing the pressurized, heated stream of liquid brine from step e) into the flash vessel such that the pressurized, heated stream of liquid brine flashes to a vapor portion and a remaining liquid portion; and g) withdrawing a vapor stream from the flash vessel. Also provided are related systems for generating a vapor.

As used herein the terms "a," "an," and "the" may include plural referents unless the context clearly dictates otherwise.

It is to be understood that directional or relative terms such as "vertical", "horizontal", "upper", "lower", "side", "top", "bottom" and the like are used for ease of description and illustrative purposes, and embodiments are not limited to a particular orientation of the systems described herein during use or normal operation.

As used herein, "feedstream" refers to a source liquid from which the vapor will be generated. In some embodiments, the feedstream comprises a feedwater and the vapor that is generated is steam. As used herein, "steam" refers to vapor-phase water. However, a person skilled in the art will understand that the steam generated by the methods described herein may also comprise one or more other volatile components of the feedwater that have a boiling point at or below that of water.

Multiple types of feedwater, of varying water quality, may be used as the feedstream. In some embodiments, the feedwater comprises at least a portion of dissolved solids therein. As used herein, "dissolved solids" may refer to any inorganic or organic substances dissolved, suspended, or otherwise present in the feedwater.

In some embodiments, the feedwater comprises produced water from a thermal oil recovery process. As used herein, a "thermal oil recovery process" refers to a process comprising in situ heating of a subterranean reservoir to mobilize the viscous oil therein such that the oil may be displaced to a production well from which it may be produced to surface. In some embodiments, the in situ heating of the reservoir is provided by injection of a heated vapor-phase working fluid. In some embodiments, the heated vapor-phase working fluid at least partially comprises steam. In some embodiments, the heated vapor-phase working fluid may contain steam additives, such as polymers or surfactants. In some embodiments, the thermal oil recovery process is Steam Assisted Gravity Drainage (SAGD), Cyclic Steam Stimulation (CSS), Steam Flooding, or any other thermal oil recovery process in which the heated vapor-phase working fluid at least partially comprises steam. As used herein, "produced water" refers to water that is produced back to surface along with the mobilized viscous oil, the bulk of which may comprise condensed injected steam.

Figure 7:
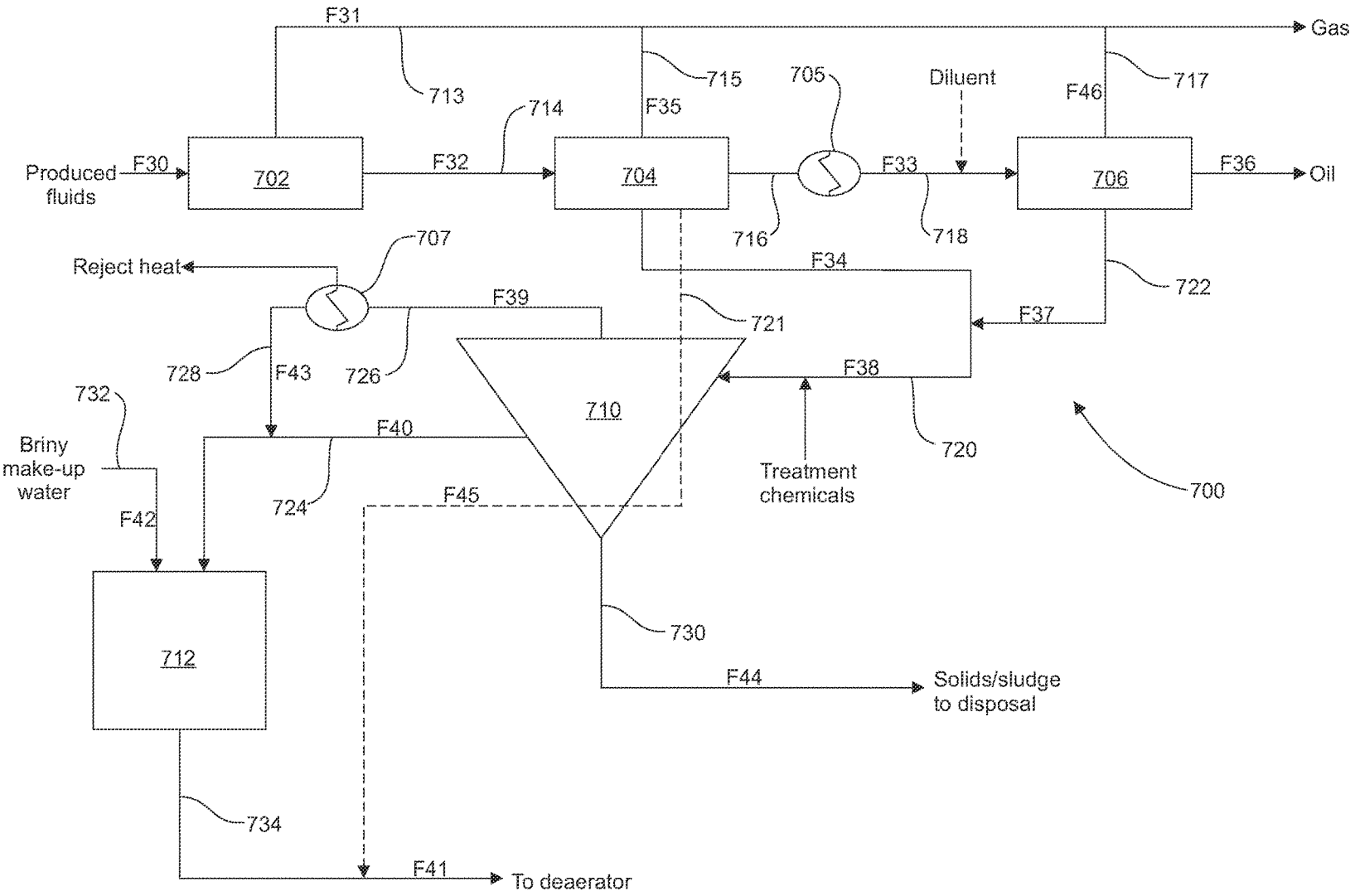
FIG. 7 is a process flow diagram of an example system for producing minimally treated produced water, according to some embodiments.

In some embodiments, the produced water is minimally treated. As used herein, "minimally treated" refers to produced water that has been at least partially de-oiled but that still contains at least some amount of oil and/or other dissolved solids therein. Non-limiting examples of dissolved solids that may be found in produced water include silica, dispersed organics, hardness, brine, and other dissolved salts. An example system for producing minimally treated produced water is shown in FIG. 7 and described in more detail below.

In some embodiments, the feedwater further comprises at least a portion of one or more solvents. In some embodiments, the solvent comprises one or more hydrocarbon solvents. Non-limiting examples of hydrocarbon solvents include propane, butane, pentane, hexane, heptane, octane, nonane, decane, undecane, dodecane, tridecane, and tetradecane. In some embodiments, the solvent comprises a multi-component solvent including but not limited to diluent, natural gas condensate, kerosene, naptha, and combinations thereof. In other embodiments, the solvent comprises dimethyl ether (DME). In some embodiments, the feedwater further comprises a portion of polymer, surfactant, and/or any other steam additive used in the heated vapor-phase working fluid.

In other embodiments, the feedwater comprises boiler feedwater. As used herein, "boiler feedwater" refers to water that is of a quality suitable to be used in conventional water-tube boilers. In some embodiments, the boiler feedwater is produced water that has been treated to reach the desired water quality. In some embodiments, the produced water has been treated to control alkalinity, prevent scaling, correct pH, and/or to control conductivity. In some embodiments, the boiler feedwater is of a quality suitable to be used in a once-through steam generator or a conventional drum boiler-type steam generator. In other embodiments, the feedstream may comprise blow-down water from a once-through steam generator or drum boiler.

In other embodiments, the feedwater may comprise brackish water. For example, the brackish water may be water from an aquifer. Brackish aquifer water is often used as make-up water in thermal oil recovery operations. In other embodiments, the feedwater may comprise sea water (saline water) or any other suitable water with a high salt content.

In other embodiments, the feedwater may comprise process or waste water from any other suitable chemical, ore, or biomass processing operation. In other embodiments, the feedstream comprises any other suitable liquid.

FIG. 1A shows an example system 100 that may implement some embodiments of the methods described herein. The system 100 will be discussed with reference to a feedstream comprising feedwater, wherein the vapor to be generated is steam.

The system 100 may comprise at least one ohmic heating device and at least one flash vessel. In FIG. 1A, the system 100 is in a first configuration comprising a single ohmic heating device 102. As used herein, "ohmic heating device" refers to an electrical heating device that generates heat by passage of electrical current through a liquid which resists the flow of electricity. In some embodiments, ohmic heating is achieved using an alternating current instead of a direct current to reduce the risk of electrode polarization and electrolysis reactions in the liquid therein. In some embodiments, the ohmic heating device 102 is the ohmic heating device 802 shown in FIGS. 8A and 8B and described in more detail below. In other embodiments, the ohmic heating device 102 is any other suitable ohmic heating device. As described in more detail below, the ohmic heating device 102 may have an operating temperature and an operating pressure suitable to avoid boiling of the liquid therein.

The ohmic heating device 102 may be operatively connected to at least one power source. In some embodiments, the ohmic heating device 102 is operatively connected to at least one variably available power source 101. As used herein, a "variably available electrical power source" refers to a power source from which the amount of available power varies at least somewhat unpredictably over time and at some time points may be zero. In some embodiments, the amount of available power varies hourly, daily, weekly, and/or seasonally. In some embodiments, the variably available electrical power source 101 comprises a single primary power plant. In other embodiments, the variably available electrical power source 101 comprises a local or regional electrical power grid that is supplied by several independently operated primary power plants.

As used herein, the "amount of available power" refers to the amount of power available to be used by the ohmic heating device 102, which may be limited by physical and/or economic factors. In some embodiments, the amount of available power may not be all of the power that is generated, for example, if some of the generated power is committed to another application or if some of the generated power is sold to an electrical power grid when the price for power is at or above a certain threshold. In other embodiments, the amount of available power may be the amount of available power from a commercial electrical power grid at or below a specific price threshold.

In some embodiments, the variably available electrical power source 101 is a low-carbon power source. As used herein "low-carbon power source" refers to a power source that produces power with substantially lower carbon dioxide emissions than conventional fossil fuel power sources. In some embodiments, the low-carbon power source comprises at least one of wind power, solar power, hydroelectric power, geothermal power, nuclear power, and combinations thereof. In some embodiments, the ohmic heating device 102 may receive power from more than one variably available electrical power source 101.

In some embodiments, the low-carbon power source comprises a co-generation power source in which power is co-generated along with heat. For example, SAGD operations may include one or more natural gas-fired co-generation plants in which electricity is co-generated along with steam for injection. In some embodiments, the SAGD "co-gen" plant may generate power continuously even when other demands for power are low.

In some embodiments, the ohmic heating device 102 may be operatively connected to at least one continuously available power source 103. As used herein, a "continuously available electrical power source" refers to a power source from which at least some amount of power is approximately constantly available, although minor fluctuations may still be possible. For example, the continuously available electrical power source may be a natural gas fired steam and power co-generation plant, an electrical power grid supplied by at least one power plant capable of continuous power generation, or any other continuously available electrical power source.

In some embodiments, the ohmic heating device 102 is operatively connected to at least one variably available power source 101 and at least one continuously available power source 103.

In some embodiments, the ohmic heating device 102 may be operable across a range of power input such that the ohmic heating device 102 can operate on both low power input (e.g. when the amount of available power is relatively low) and high power input (e.g. when the amount of available power is relatively high). On low power input, the ohmic heating device 102 may deliver a relatively low heating rate and, on high power input, the ohmic heating device 102 may deliver a relatively high heating rate.

The system 100 may further comprise a flash vessel 104 in fluid communication with the ohmic heating device 102. As described in more detail below, the flash vessel 104 may have an operating temperature and an operating pressure lower than that of the ohmic heating device 102. As used herein, a "flash vessel", also referred to as a "flash drum", refers to a device in which a heated liquid undergoes a rapid separation into a vapor portion and a remaining liquid portion by a flash cooling mechanism. "Flash cooling" or "flashing" refers to a phenomenon wherein a fraction of a heated volume of liquid evaporates when exposed to a reduction in confining pressure and the temperature of the remaining liquid is reduced to the gas-liquid saturation temperature at the reduced pressure. Flash cooling may also precipitate at least a portion of any dissolved solids in the original liquid and the precipitated solids may be incorporated into the remaining liquid in the flash vessel.

In this embodiment, the flash vessel 104 is a vertical flash vessel. In other embodiments, the flash vessel 104 may be a horizontal flash vessel. It will be understood that although the flash vessel 104 is represented by a simplified block diagram in FIG. 1, the flash vessel 104 may be approximately cylindrical or any other suitable shape. The flash vessel 104 may have an upper end 105, a lower end 106, and a side wall 107 extending circumferentially around the flash vessel 104. The flash vessel 104 may define a flash chamber 109 therein.

In some embodiments, the flash chamber 109 of the flash vessel 104 contains a liquid brine phase 108 therein. As used herein, "brine" refers to a high concentration solution of a salt in water. As used herein, "liquid brine phase" refers to a volume of liquid brine within the flash vessel 104 that is distinct from the slurry phase 110, described in more detail below. In some embodiments, the brine comprises sodium chloride. In other embodiments, the brine comprises any other suitable type of salt including, but not limited to, sodium sulfate, sodium chloride, sodium bicarbonate, calcium sulfate, calcium chloride, calcium bicarbonate, magnesium sulfate, magnesium chloride and magnesium bicarbonate. In some embodiments, the brine is a saturated solution of the salt. In this embodiment, the water forming the brine is at least partially comprised of the feedwater, as described in more detail below. As a result, the brine may further comprise at least a portion of dissolved solids from the feedwater therein. The brine may have a relatively high electrical conductivity as a consequence of its high dissolved solids loading. By providing a saturated brine solution, at least a portion of the dissolved solids may readily precipitate during flash cooling.

In some embodiments, the liquid brine phase 108 in the flash vessel 104 may be of a sufficient volume to facilitate settling of precipitated solids to form a slurry phase 110 in the flash chamber 109, proximate to the lower end 106 of the flash vessel 104. As used herein, "slurry phase" refers to a relatively thick suspension of precipitated solids in liquid brine.

In some embodiments, the liquid brine phase 108 may be maintained at or above a threshold (minimum) volume to allow for a relatively quick start-up mode during which no feedwater is supplied to the flash vessel 104, as described in more detail below. In some embodiments, the threshold volume may be selected such that a top level 132 of the liquid brine phase 108 remains above a liquid outlet 115 of the flash vessel 104 from which a stream of liquid brine is withdrawn. In some embodiments, the threshold volume may be selected such that the top level 132 of the liquid brine phase 108 is a specific height above the liquid outlet 115 such that the liquid brine phase may be drawn down during the start-up period without falling below the liquid outlet 115. For example, when there is no supply of the feedwater to the flash vessel 104, and the liquid brine phase 108 is brought to the operating temperature to generate steam, there may be a decrease of about 7% of the total volume of the liquid brine phase 108 when the flash vessel 104 attains the operating pressure. Therefore, in some embodiments, the threshold volume may be such that the drop in about 7% in total volume does not bring the liquid level 132 below the liquid outlet 115. As one specific example, if the liquid outlet 115 is positioned at a height of about 20% of the flash vessel 104 volume, then the threshold volume may be such that the liquid level 132 would be at about 22% of the flash vessel 104 volume. In other embodiments, the threshold volume may be any other suitable volume.

In some embodiments, the liquid brine phase 108 may also be maintained approximately at a maximum volume. In some embodiments, the maximum volume is selected such that there is a sufficient volume of liquid brine to allow the system 100 to operate in the start-up mode for a suitable period of time, but not too high of a volume such that flash cooling is impeded.

In this embodiment, the flash vessel 104 comprises a flash inlet 111, a liquid inlet 113, the liquid outlet 115, a vapor outlet 117, and a slurry outlet 119. In other embodiments, the flash vessel 104 may comprise any other suitable number and arrangement of inlets and outlets and embodiments are not limited to the specific configuration shown in FIG. 1 and described herein.

The flash inlet 111 may comprise any suitable inlet or nozzle that allows for a reduction in pressure of the fluid entering the flash vessel 104 such that flash cooling occurs. The flash inlet 111 may also be referred to as a "pressure-reducing nozzle" 111. The pressure-reducing nozzle may comprise, for example, a single-fluid (hydraulic) spray nozzle or a two-fluid (pneumatic) spray nozzle. A fan spray nozzle may be preferable in some embodiments to minimize potential nozzle plugging and to generate coarse liquid droplets larger than or equal to about 300 μm. In some embodiments, the flash inlet 111 is located above the top level 132 of the liquid brine phase 108 such that the fluid to be flashed may enter the flash vessel 104 above the liquid brine phase 108. In some embodiments, the flash inlet 111 to the flash vessel 104 may be fluidly connected to the ohmic heating device 102 via a fluid conduit 120. As used herein, "fluid conduit" will be understood to include one or more pipes, hoses ducts, tubes, channels, or the like, in any suitable size, shape, or configuration. Embodiments are not limited to any specific type of fluid conduit.

The liquid inlet 113 may be positioned below the flash inlet 111. In this embodiment, the liquid inlet 113 is rotationally offset from the flash inlet 111 around the circumference of the side wall 107. In other embodiments, the liquid inlet 113 is at any other suitable position.

The liquid outlet 115 may be positioned below the flash inlet 111 and the liquid inlet 113. In this embodiment, the liquid outlet 115 is approximately parallel to the flash inlet 111 and rotationally offset from the liquid inlet 113. In other embodiments, the liquid outlet 115 is at any other suitable position.

The vapor outlet 117 may be positioned at the upper end 105 of the flash vessel 104 to allow at least a portion of the vapor to be withdrawn from the flash vessel 104. In some embodiments, a fluid conduit 122 may extend from the vapor outlet 117 to convey the vapor from the vapor outlet 117 to one or more downstream locations for use and/or further processing. In some embodiments, a valve 123 may be in fluid communication with the fluid conduit 122 to control the flow of vapor therethrough.

Optionally, the flash vessel 104 further comprises a mist eliminator 112 within the flash chamber 109, proximate the vapor outlet 117. The mist eliminator 112 may function to at least partially remove any liquid droplets in the vapor prior to the vapor being withdrawn from the flash vessel 104 via the vapor outlet 117.

The slurry outlet 119 may be positioned at the lower end 106 of the flash vessel 104 to allow at least a portion of the slurry phase 110 to be withdrawn from the flash vessel 104. In some embodiments, a fluid conduit 128 may extend from the slurry outlet 119 to convey slurry to at least one downstream location for further processing and/or disposal. In some embodiments, a valve 125 may be in fluid communication with the fluid conduit 128 to control the flow of slurry therethrough.

In some embodiments, the system 100 further comprises at least one pump. In this embodiment, the system 100 comprises a first pump 114 and a second pump 124. In some embodiments, at least one of the first pump 114 and the second pump 124 is a high pressure pump. For example, a multi-stage centrifugal pump may be suitable to generate sufficient fluid pressure to achieve the operating pressure of the flash vessel 104. The first pump 114 and second pump 124 are preferably constructed of corrosion-resistant and high temperature-resistant metal alloys.

The first pump 114 may be in fluid communication with the flash vessel 104 and the ohmic heating device 102. In this embodiment, the first pump 114 is fluidly connected to the flash vessel 104 via a fluid conduit 116 extending from the liquid outlet 115 of the flash vessel 104 to the first pump 114. The first pump 114 may be fluidly connected to the ohmic heating device 102 via another fluid conduit 118.

The second pump 124 may be in fluid communication with the flash vessel 104. In this embodiment, the second pump 124 is fluidly connected to the flash vessel 104 via a fluid conduit 126. In some embodiments, a valve 127 is in fluid communication with the fluid conduit 126 to control the flow of fluid therethrough. In some embodiments, the valves 123, 125, and 127 may be used to isolate the flash vessel 104 from the fluid conduits 122, 128, and 126, respectively. During normal operation, the valves 123, 125, and 127 may remain open.

The second pump 124 may also be fluidly connected to an upstream feedstream processing system (not shown) via a fluid conduit 130. In some embodiments, the upstream feedstream processing system is the upstream feedstream processing system 500 shown in FIG. 5 and discussed below.

In some embodiments, the system 100 comprises a control system (not shown). The control system may be configured to implement embodiments of the methods described herein. In some embodiments, the control system is operatively connected to one or more of the ohmic heating device 102, the flash vessel 104, the first and second pumps 114 and 124, and the valves 123, 125, and 127 to control operation thereof. In other embodiments, one or more of the ohmic heating device 102, the flash vessel 104, the first and second pumps 114 and 124, and the valves 123, 125, and 127 may be operated manually.

In operation, the system 100 in this embodiment may operate as follows. The second pump 124 may receive a feedstream F1 from the upstream processing system via the fluid conduit 130. In some embodiments, the feedstream F1 is filtered before being received by the second pump 124. In some embodiments, the upstream feedstream processing system comprises a deaerator such that the feedstream F1 is deaerated before being received by the second pump 124, as described in more detail below. Deaeration may be desirable as some dissolved gases, such as oxygen and carbon dioxide, can increase the risk of corrosion of fluid lines and equipment of the systems described herein. In some embodiments, deaeration also heats the feedstream F1 such that the feedstream F1 is pre-heated before being received by the second pump 124. The second pump 124 may pressurize the feedstream F1 and pump a pressurized feedstream F2 to the flash vessel 104 via the fluid conduit 126 and the liquid inlet 113. In some embodiments, the second pump 124 pressurizes the feedstream F2 to at least the operating pressure of the flash vessel 104. The pressurized feedstream F2 may then combine with the liquid brine phase 108 in the flash vessel 104 to maintain the liquid brine phase 108 at the desired level.

The first pump 114 may withdraw a stream F3 of liquid brine from the liquid brine phase 108 of the flash vessel 104 via the liquid outlet 115 and the fluid conduit 116. The first pump 114 may then pressurize the stream F3 to produce a stream F4 of over-pressurized brine and pump the stream F4 to the ohmic heating device 102 via the fluid conduit 118. The first pump 114 may thereby function as a brine circulation pump.

The ohmic heating device 102 may heat the stream F4 to produce a stream F5 of over-heated, over-pressurized brine. In some embodiments, the temperature of the stream F5 of over-heated, over-pressurized brine may be controlled by controlling the heating rate of the ohmic heating device 102. In other embodiments, the temperature of the stream F5 may be controlled by controlling the brine circulation rate (i.e. the pumping flow rate) provided by the first pump 114. In other embodiments, the temperature of the stream F5 may be controlled by controlling the combination of both the heating rate and the brine circulation rate.

The fluid conduit 120 may convey the stream F5 of over-heated, over-pressurized brine from the ohmic heating device 102 to the flash inlet 111 of the flash vessel 104. The stream F5 may be flashed in the flash chamber 109 to a vapor portion (steam) and a remaining liquid portion. The remaining liquid portion may be at the operating temperature and operating pressure of the flash vessel 104 and may enter the liquid brine phase 108.

The vapor portion may be demisted by the mist eliminator 112 and a vapor stream F6 may then be withdrawn from the flash vessel 104 via the vapor outlet 117 and the fluid conduit 122 for use and/or further processing. At least a portion of the dissolved solids in the stream F5 may precipitate as the stream F5 is flashed to the vapor portion and the remaining liquid portion and the precipitated solids may enter the slurry phase 110. A slurry stream F7 may be withdrawn from the flash vessel 104 via the slurry outlet 119 and the fluid conduit 128 for further processing and/or disposal.

In some embodiments, the system 100 may be operated to generate a vapor (i.e. steam, in this example) continuously or intermittently. As used herein, "continuous" vapor (steam) generation or "continuous" operation of the system 100 refers to generating vapor substantially constantly although some interruptions may be required, for example, for maintenance or repairs to the system 100. In some embodiments, steam generation may be continuous when the ohmic heating device 102 receives power from at least one continuously available power source 103 and the ohmic heating device 102 continuously receives sufficient power to heat the stream F4 of over-pressurized brine.

As used herein, "intermittent" vapor (steam) generation or "intermittent" operation of the system 100 refers to generating vapor at an irregular and/or non-continuous rate. In some embodiments, steam generation may be intermittent when the ohmic heating device 102 receives power from at least one variably available power source 101 and the ohmic heating device 102 is only able to heat the stream F4 of over-pressurized brine to a sufficient temperature when sufficient power is available from the variably available power source 101.

During intermittent operation, when the ohmic heating device 102 is inactive, the deaerator of the upstream feedstream processing system (described in more detail with respect to FIG. 5 below) may also be inactive such that the deaerated feedstream F1 is not being supplied to the system 100. When sufficient power becomes available, there may be an initial delay before the deaerator can reach its required operating temperature to supply the deaerated feedstream F1 to the system 100 again. Therefore, there may also be an initial delay before steam can be generated again. To reduce or eliminate this initial delay, it may be desirable to provide a means to quickly re-initiate steam generation during intermittent operation.

In some embodiments, during intermittent operation, there may be periods in which the ohmic heating device 102 is receiving some power but not enough to raise the temperature of the stream F4 to the extent needed to undergo flash cooling in the flash vessel 104. Therefore, in some embodiments, the system 100 may operate in a "stand-by" mode during periods in which steam is not being generated.

In some embodiments, when the system 100 is in the stand-by mode, the flash vessel 104 is isolated from the fluid conduits 122, 128, and 126 by closing the valves 123, 125, and 127. In this mode, the fluid streams F2, F6, and F7 may substantially be zero. In the stand-by mode, the first pump 114 and the ohmic heating device 102 may be periodically operated (on low power input) for short periods to maintain the pressure (and corresponding saturation temperature) within the flash vessel 104 just below the operating pressure and temperature required for flash cooling of the stream F5.

In some embodiments, to re-initiate steam generation when sufficient power is available to the ohmic heating device 102, the system 100 may be transitioned from the stand-by mode to a "start-up" mode. In some embodiments, the first pump 114 and the ohmic heating device 102 may be operated continuously, at a constant or increasing rate of electrical power input to the ohmic heating device 102, until the pressure of the flash vessel 104 reaches the desired operating pressure and corresponding temperature to allow flash cooling of the stream F5 to occur. Thereafter, the valve 123 may be opened such that at least a portion of the steam generated in the flash vessel 104 may be withdrawn through the fluid conduit 122. When the system 100 is in the start-up mode, the volume of the liquid brine phase 108 in the flash vessel 104 may be drawn down below its maximum volume but not to the extent that the liquid brine phase 108 falls below its threshold volume as discussed above.

Once the deaerator reaches its required operating temperature and the deaerated feedstream F1 is being supplied to the second pump 124 again, the valve 127 may be opened and the pressurized feedstream F2 may be introduced into the flash vessel 104 again. The pressurized feedstream F2 may raise the volume of the liquid brine phase 108 back to its maximum volume. Thereafter, the system 100 can return to normal operation in which pressurized feedstream F2 is continuously introduced into the flash vessel 104 and the vapor stream is continuously withdrawn. The valve 125 may also be opened to allow for withdrawal of the slurry stream F7 to commence and thereafter continue continuously or as required.

Figure 1B:
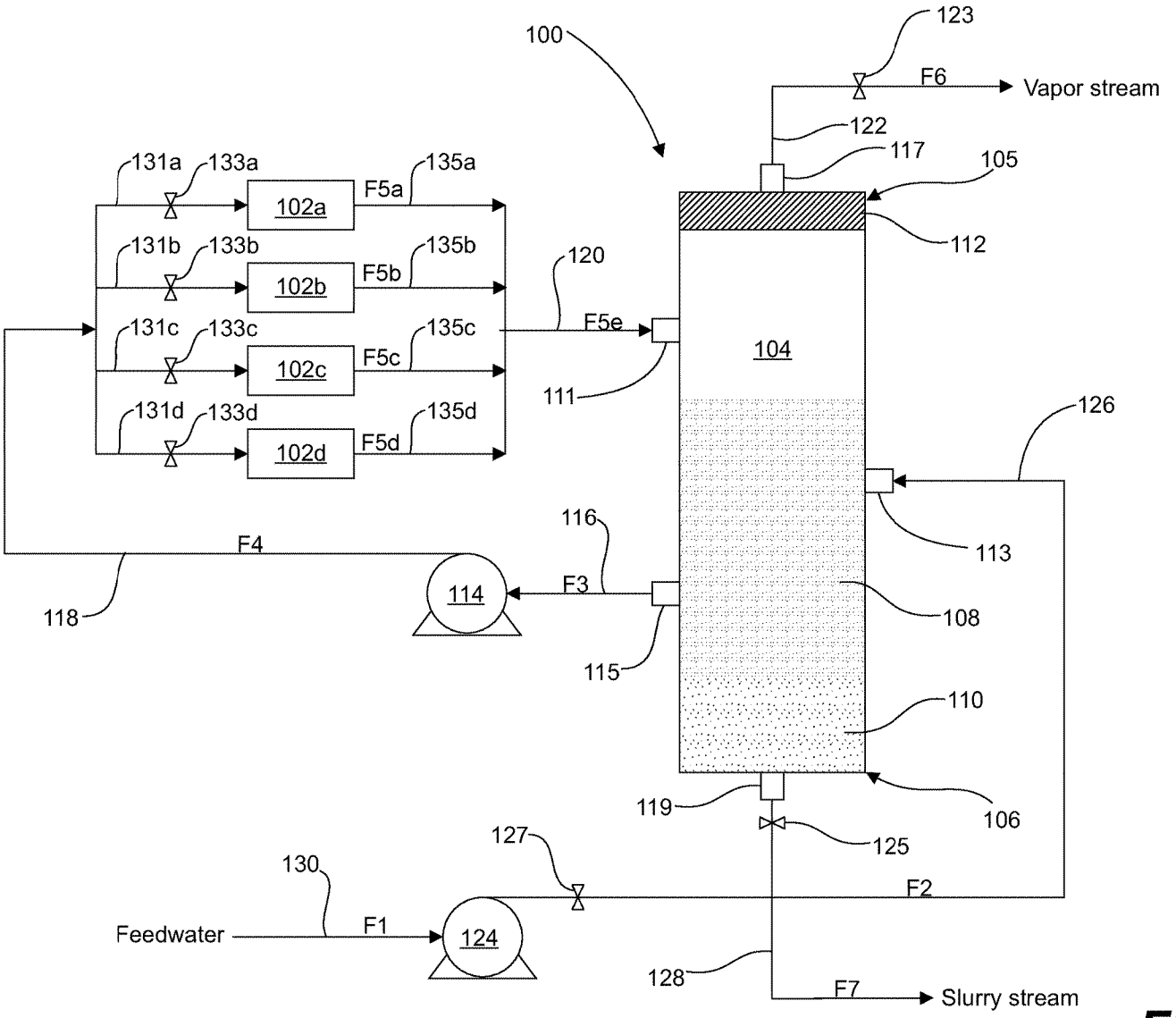
FIG. 1B is a process flow diagram of the system of FIG. 1A, shown in a second configuration, according to some embodiments.

FIG. 1B shows the system 100 in a second configuration in which two or more ohmic heating devices are in fluid communication with a single flash vessel. In this embodiment, the system 100 comprises a first, second, third, and fourth ohmic heating device 102*a*, 102*b*, 102*c*, and 102*d* in fluid communication with the flash vessel 104. In other embodiments, the system 100 may comprise any other suitable number of ohmic heating devices.

Figure 8A:
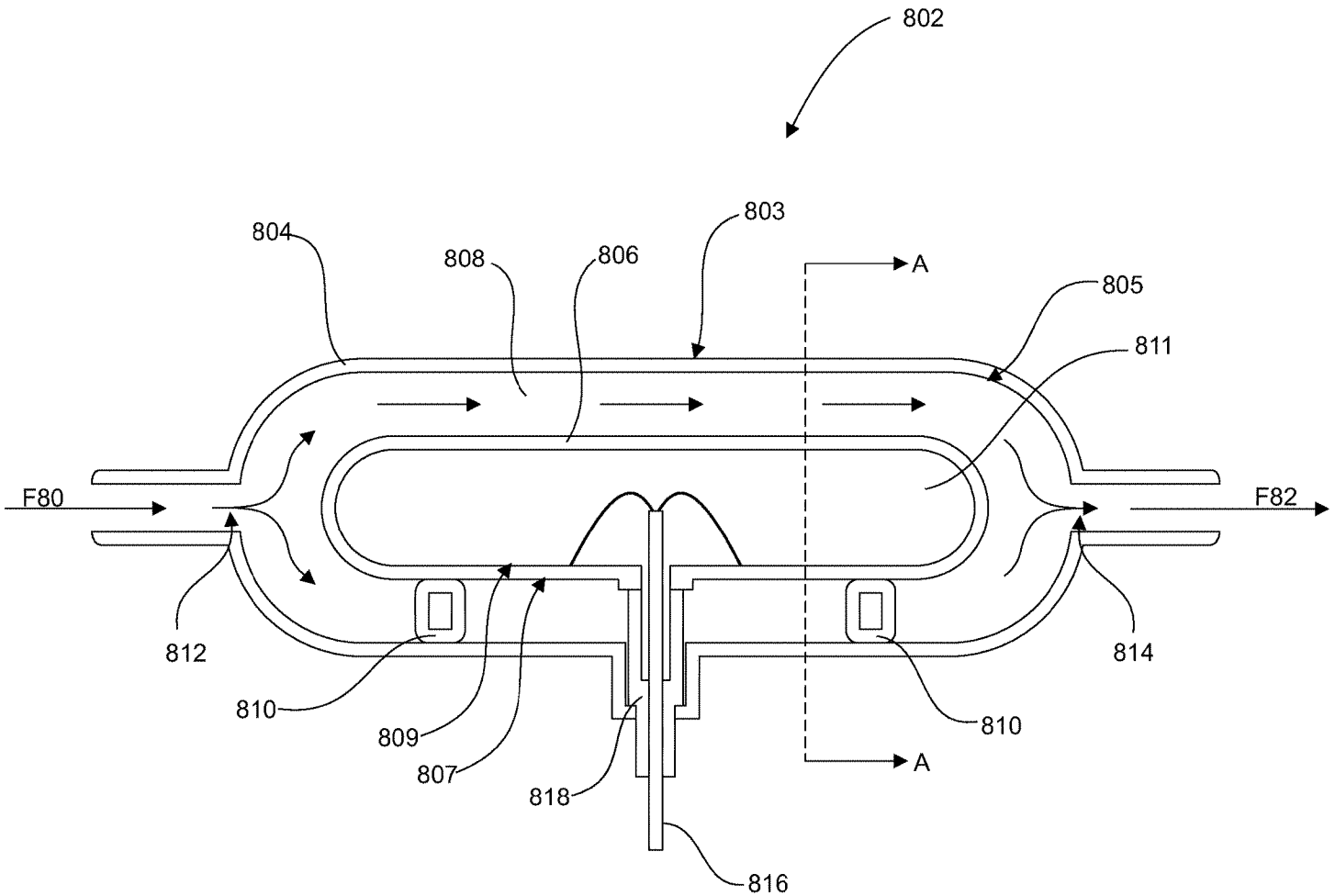
FIG. 8A is a side view of an example ohmic heating device, according to some embodiments.
Figure 8B:
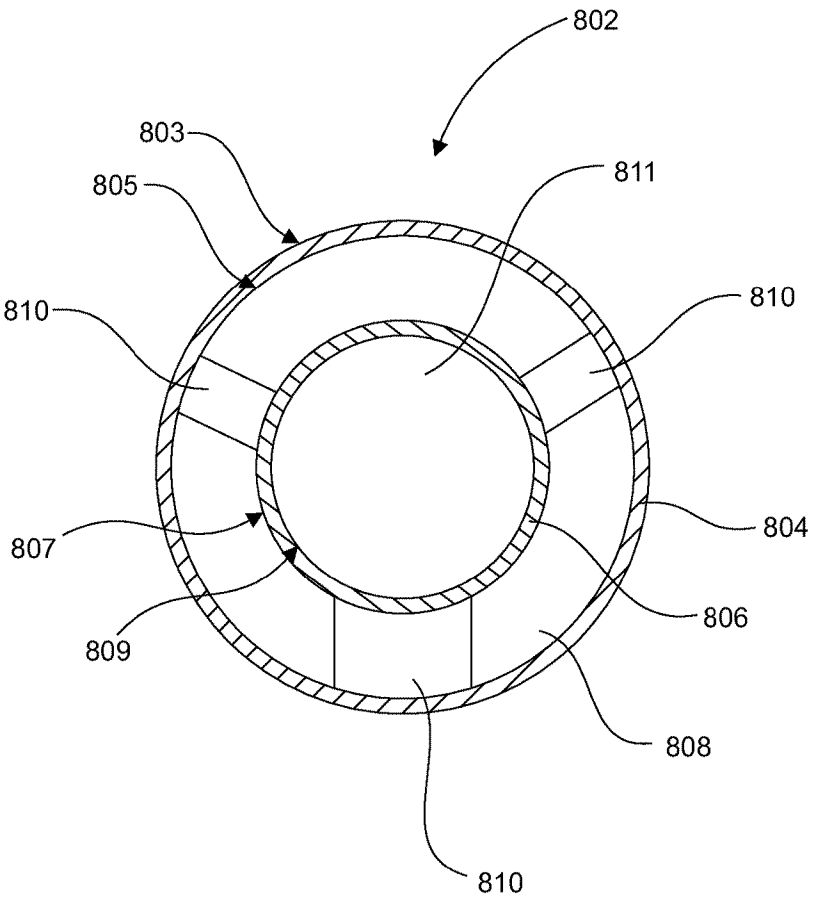
FIG. 8B is a cross-sectional view of the ohmic heating device of FIG. 8A, taken along line A-A.

In some embodiments, the ohmic heating devices 102*a*, 102*b*, 102*c*, and 102*d* may each be similar in structure to the ohmic heating device 802 of FIGS. 8A and 8B. In other embodiments, the ohmic heating devices 102*a*, 102*b*, 102*c*, and 102*d* may each be any other suitable ohmic heating device. Although blocks representing the ohmic heating devices 102*a*, 102*b*, 102*c*, and 102*d* in FIG. 1B are shown as smaller than the block representing the ohmic heating device 102 in FIG. 1A, it will be understood that the ohmic heating devices 102*a*, 102*b*, 102*c*, and 102*d* may be any suitable size and may be the same size or larger than the ohmic heating device 102 in some embodiments.

Each of the ohmic heating devices 102*a*, 102*b*, 102*c*, and 102*d* may be operatively connected to at least one power source (not shown). In some embodiments, the ohmic heating devices 102*a*, 102*b*, 102*c*, and 102*d* may be operatively connected to at least one variably available power source and/or at least one continuously available power source similar to the variably available power source 101 and the continuously available power source 103 of FIG. 1A. In some embodiments, all of the ohmic heating devices 102*a*, 102*b*, 102*c*, and 102*d* are operatively connected to the same power source(s). In other embodiments, one or more of the ohmic heating devices 102*a*, 102*b*, 102*c*, and 102*d* may be operatively connected to a different power source.

In this embodiment, the fluid conduit 118 is fluidly connected to fluid conduits 131*a*, 131*b*, 131*c*, and 131*d* to deliver the stream F4 of pressurized liquid brine to the first, second, third, and fourth ohmic heating devices 102*a*, 102*b*, 102*c*, and 102*d*, respectively. In some embodiments, valves 133*a*, 133*b*, 133*c*, and 133*d* are in fluid communication with the fluid conduits 131*a*, 131*b*, 131*c*, and 131*d* to control the flow of the stream F4 of pressurized liquid brine therethrough. In some embodiments, the valves 133*a*, 133*b*, 133*c*, and 133*d* may be independently operable to independently control the flow of the stream F4 into each of the ohmic heating devices 102*a*, 102*b*, 102*c*, and 102*d*.

Each of the ohmic heating devices 102*a*, 102*b*, 102*c*, and 102*d* may thereby receive a portion of the stream F4 of pressurized liquid brine and may heat the pressurized liquid brine to produce streams F5*a*, F5*b*, F5*c*, and F5*d* of over-heated, over-pressurized liquid brine, respectively.

Also in this embodiment, the fluid conduit 120 is fluidly connected to the ohmic heating devices 102*a*, 102*b*, 102*c*, and 102*d* via fluid conduits 135*a*, 135*b*, 135*c*, and 135*d*, respectively. The fluid conduits 135*a*, 135*b*, 135*c*, and 135*d* may convey streams F5*a*, F5*b*, F5*c*, and F5*d* of over-heated, over-pressurized liquid brine from the first, second, third, and fourth ohmic heating device 102*a*, 102*b*, 102*c*, and 102*d*, respectively, to the fluid conduit 120 to form a consolidated fluid stream F5*e*. The consolidated fluid stream F5*e* may be received into the flash vessel 104 via the flash inlet 111 and flashed to a vapor portion and a remaining liquid portion, as described above with respect to the stream F5 of FIG. 1A.

In some embodiments, when all of the valves 133*a*, 133*b*, 133*c*, and 133*d* are open, all four of the streams F5*a*, F5*b*, F5*c*, and F5*d* of over-heated, over-pressurized liquid brine may be generated from the ohmic heating device 102*a*, 102*b*, 102*c*, and 102*d* simultaneously. The consolidated stream F5*e* may therefore consolidate all four streams to be flashed in the flash vessel 104. The flash vessel 104 in this configuration may have a relatively large capacity such that the consolidated stream F5*e* (combining all four of the streams F5*a*, F5*b*, F5*c*, and F5*d* of over-heated, over-pressurized liquid brine) may be flashed at once.

When one or more of the valves 133*a*, 133*b*, 133*c*, and 133*d* is closed, one or more of the streams F5*a*, F5*b*, F5*c*, and F5*d* may not be generated and only the remaining streams may be consolidated into the consolidated stream F5*e* to be flashed in the flash vessel 104. Thus, in some embodiments, the volume of vapor generated by the flash vessel 104 at a given time may be increased or decreased by opening and closing the valves 133*a*, 133*b*, 133*c*, and 133*d* as appropriate.

The configuration of the system 100 shown in FIG. 1B may operate continuously or intermittently, and may operate in a stand-by mode and a start-up mode, similar to the configuration shown in FIG. 1A and discussed above.

Therefore, in some embodiments, by providing multiple ohmic heating devices in fluid communication with a relatively large flash vessel, the steam generation capacity of the system 100 may be relatively high. In some embodiments, the steam generation capacity of the system 100 in this configuration may be at least equivalent to that of conventional fired steam generation systems.

In some embodiments, the system 100 (in either configuration) may be installed at a surface facility of a thermal oil recovery process operation to generate steam for injection into the reservoir via at least one injection well (not shown). In some embodiments, the thermal oil recovery process operation is a SAGD operation or a CSS operation. In other embodiments, the thermal oil recovery process operation is a steam flooding operation or any other suitable thermal oil recovery process operation in which the heated vapor-phase working fluid at least partially comprises steam. In some embodiments, the system 100 is installed at or near a SAGD or CSS injection well or well pad. In other embodiments, the system 100 is installed at a central processing facility that may be located about 1 km to about 10 km from the injection well or well pad.

In some embodiments, the system 100 is installed as a stand-alone source of steam for the thermal oil recovery process operation. In other embodiments, the system 100 may be installed in combination with conventional steam generation and boiler feedwater treatment facilities where it may be used to provide a supplementary supply of steam to augment the supply of conventionally generated steam.

In some embodiments, the system 100 may be used to implement a thermal oil recovery process that involves intermittent injection of steam such as the process described in Canadian Patent Application No. 3,057,184, incorporated herein by reference.

In other embodiments, the system 100 may be installed at any other type of facility in which vapor generation is required including, but not limited, to seawater desalination, oilfield produced water, CSS, steam flooding, or any other suitable application.

Figure 2:
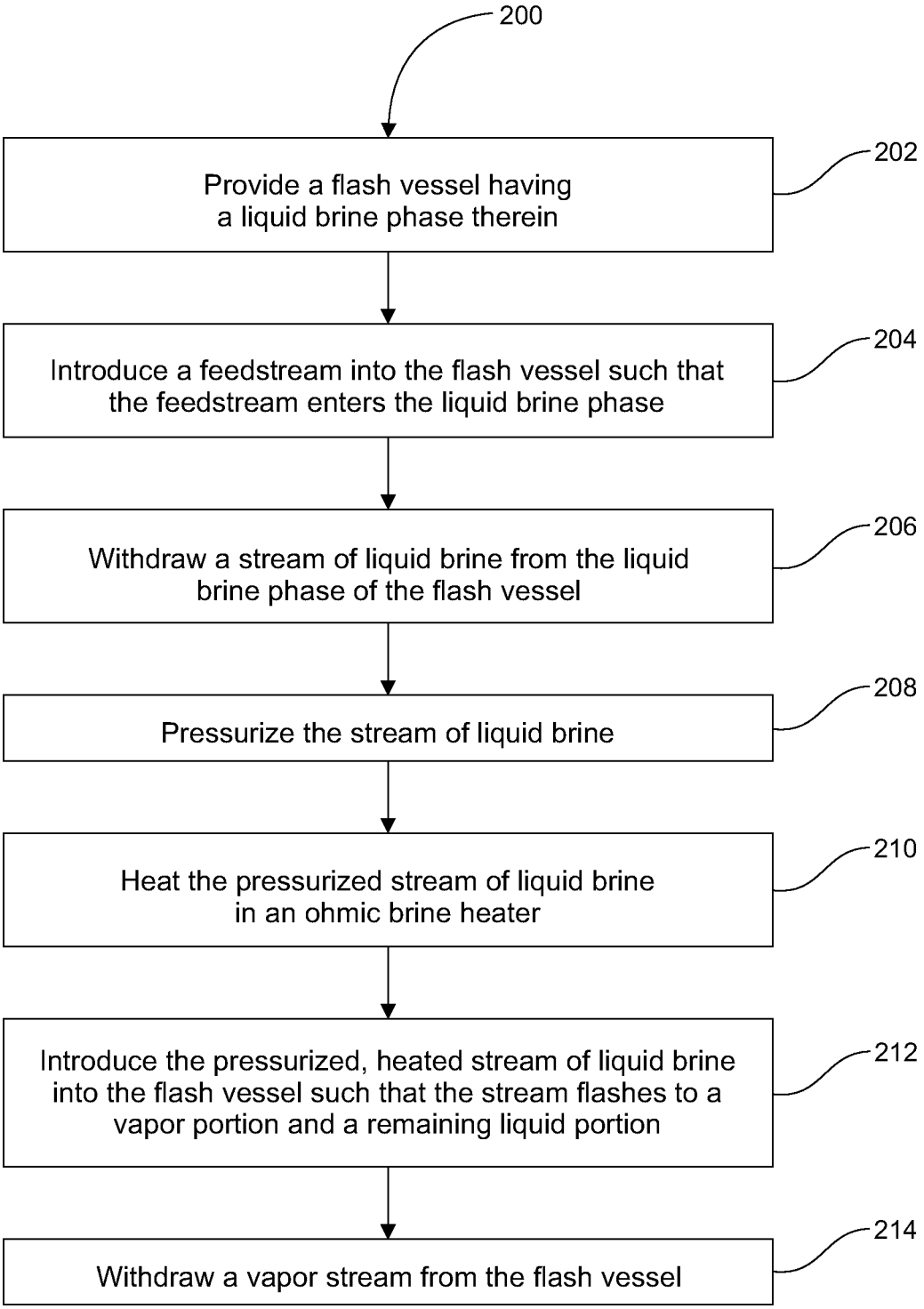
FIG. 2 is a flowchart of an example method for generating a vapor, implemented using the system of FIG. 1A, according to some embodiments.

FIG. 2 is a flowchart of an example method 200 for generating a vapor, implemented using the system 100 of FIG. 1A.

At block 202, a flash vessel 104 is provided having a liquid brine phase 108 therein. The flash vessel 104 may operate at a first temperature and a first pressure. The liquid brine phase 108 within the flash vessel 104 may therefore be at the first temperature and the first pressure. In some embodiments, the first temperature may range from about 120° C. to about 320° C. In other embodiments, the first temperature may be any other suitable temperature.

In some embodiments, the first pressure is selected based on a desired pressure of the steam to be generated from the flash vessel 104. In some embodiments, the first pressure may range from about 0.2 MPa to about 10 MPa. For example, in embodiments in which the system 100 is located at a centralized plant supplying steam to multiple SAGD well pads, the desired steam pressure may be about 10 MPa. In other embodiments in which the system 100 is located at or near a SAGD well pad, the desired steam pressure may be about 5 MPa. In other embodiments, the operating pressure may be any other suitable pressure.

At block 204, a feedstream may be introduced into the flash vessel 104 such that the feedstream enters the liquid brine phase 108. In this embodiment, the feedstream comprises a feedwater. The feedwater may be any of the feedwaters described above and may have at least a portion of dissolved solids therein. The feedstream may be at or above the first pressure of the flash vessel 104 when it is introduced into the flash vessel 104. In some embodiments, introducing the feedstream into the flash vessel 104 comprises pumping the feedstream into the flash vessel 104 via the second pump 124 at or above the first pressure.

In some embodiments, the feedstream is deaerated before being introduced into the flash vessel 104. In some embodiments, the feedstream is filtered before being introduced into the flash vessel. In some embodiments, the feedstream is deaerated and/or filtered at an upstream feedstream processing system, as described in more detail below.

In some embodiments, at least one water treatment agent (also referred to as a water treatment chemical herein) may be introduced into the liquid brine phase 108. Non-limiting examples of water treatment agents include a nucleation agent, a coagulation agent, and a flocculation agent. Non-limiting examples of nucleation, coagulation and flocculation agents used for water treatment include aluminum sulfate, aluminum chloride, aluminum chlorohydrate, ferric and ferrous sulfate, lime, soda ash, caustic, sodium silicate, and polyacrylamide. In some embodiments, the treatment agent may be added to the feedstream such that the treatment agent is introduced into the liquid brine phase 108 along with the feedstream. In other embodiments, the treatment agent may be added directly to the flash vessel 104.

At block 206, a stream of liquid brine is withdrawn from the liquid brine phase 108 of the flash vessel 104. In some embodiments, the stream of liquid brine may comprise at least a portion of the dissolved solids from the feedwater therein.

At block 208, the stream of liquid brine is pressurized to a second pressure, the second pressure being higher than the first pressure. In some embodiments, the stream of liquid brine is pressurized by pumping the stream through the first pump 114 to the second pressure. In some embodiments, the second pressure is between about 0.5 MPa to about 14.5 MPa. In other embodiments, the second pressure may be any other suitable pressure above the first pressure to allow flash cooling to occur at block 212 as described below.

At block 210, the pressurized stream of liquid brine is heated in the ohmic heating device 102 to a second temperature, the second temperature higher than the first temperature. In some embodiments, the second temperature is between about 150° C. to about 345° C. In other embodiments, the second temperature is any other suitable temperature above the first temperature. In some embodiments, the second pressure and the second temperature are selected to prevent boiling of the liquid brine such that the brine remains in the liquid phase within the ohmic heating device 102.

At block 212, the pressurized, heated stream of liquid brine is introduced into the flash vessel 104 such that the pressurized, heated stream flashes to a vapor portion (steam) and a remaining liquid portion, the remaining liquid portion being at the first pressure and the first temperature and entering the liquid brine phase 108. At least a portion of the dissolved solids in the pressurized, heated stream of liquid brine may thereby precipitate and the precipitated solids may settle into the slurry phase 110. In some embodiments, the vapor portion comprises approximately 4% to 20% of the pressurized, heated stream of liquid brine and the remaining liquid portion comprises the remaining approximately 80% to 96%.

In some embodiments, the vapor portion is demisted via the mist eliminator 112 to at least partially remove any liquid droplets suspended therein.

At block 214, a vapor (steam) stream may then be withdrawn from the flash vessel 104. In some embodiments, the vapor stream comprises high-pressure steam. For example, the high-pressure steam may have a pressure of about 5 MPa to 10 MPa as discussed above. In other embodiments, the vapor stream comprises low-pressure steam. For example, the low-pressure steam may have a pressure of about 0.2 MPa to about 5 MPa. In other embodiments, the steam may have any suitable pressure based on the first pressure of the flash vessel 104.

In some embodiments, the vapor stream may be directed to one or more downstream facilities for use and/or further processing. In some embodiments, the vapor stream may be used in a thermal oil recovery process, for example, a SAGD process or a CSS process. For example, at least a portion of the vapor stream may be injected via at least one injection well into a subterranean reservoir as part of the thermal oil recovery process.

In some embodiments, the method 200 further comprises withdrawing a slurry stream comprising precipitated solids from the flash vessel 104. In some embodiments, the slurry stream may be directed to one or more downstream facilities for further processing and/or disposal. Example steps for further processing of the slurry stream are described in more detail below.

In some embodiments, the steps at blocks 204 to 214 may be repeated in as many cycles as required to produce a desired volume of steam over a given period of time. In some preferred embodiments, the slurry stream is withdrawn at each cycle. In other embodiments, the slurry stream may be withdrawn every two or more cycles.

In some embodiments, the steps at blocks 204 to 214 may be repeated continuously. In other embodiments, the steps at blocks 204 to 214 may be repeated intermittently with periods of varying time in between each cycle in which steam is not being generated.

As described above, during intermittent operation, the ohmic heating device 102 may receive power from at least one variably available power source 101 and may only heat the pressurized stream of liquid brine at block 210 to a sufficient extent to allow flash cooling to occur at block 212 when sufficient power is available. During periods in which sufficient power is not available, the system 100 may be in the stand-by mode, as described above.

In some embodiments, when the system 100 is in the stand-by mode, the steps at blocks 206 to 210 may be repeated periodically at a lower pressure and a lower temperature such that when the pressurized, heated stream of liquid brine is introduced into the flash vessel 104, the liquid brine does not undergo flash cooling but maintains the flash vessel 104 at a pressure and temperature just below the first pressure and the first temperature. In some embodiments, the pressure of the flash vessel 104 may be maintained in a range of about 2 MPa up to about the desired steam pressure, which may be about 5 MPa to about 10 MPa.

Once sufficient power becomes available to the ohmic heating device 102, the system 100 may transition from the stand-by mode to the start-up mode. In some embodiments, during the start-up mode, the steps at blocks 206 to 214 may be repeated prior to introducing the additional feedstream at block 204. Therefore, in some embodiments, at least some steam may be generated before additional deaerated feedstream can be introduced at block 204.

To enable the start-up mode described above, in some embodiments, the method 200 further comprises maintaining the liquid brine phase 108 at or above a threshold volume. In some embodiments, maintaining the liquid brine phase 108 at or above the threshold volume comprises maintaining the liquid brine phase at approximately a maximum volume.

Therefore, in some embodiments, the method 200, implemented using the system 100, provides integrated steam generation and water treatment to remove at least a portion of the dissolved solids from a feedstream. The method 200 may therefore be used to generate steam from feedwater having varying water quality without the need for additional water treatment facilities or with only minimal additional water treatment facilities. By using an ohmic heating device 102, heat transfer surfaces, and associated fouling, may be avoided. In addition, as the ohmic heating device 102 may receive power from a variably available low-carbon power source, greenhouse gas emissions may be greatly reduced compared to that of conventional steam generation methods. By operating the ohmic heating device 102 under conditions to avoid boiling, the risk of electrical arcing may thereby be reduced.

Figure 3:
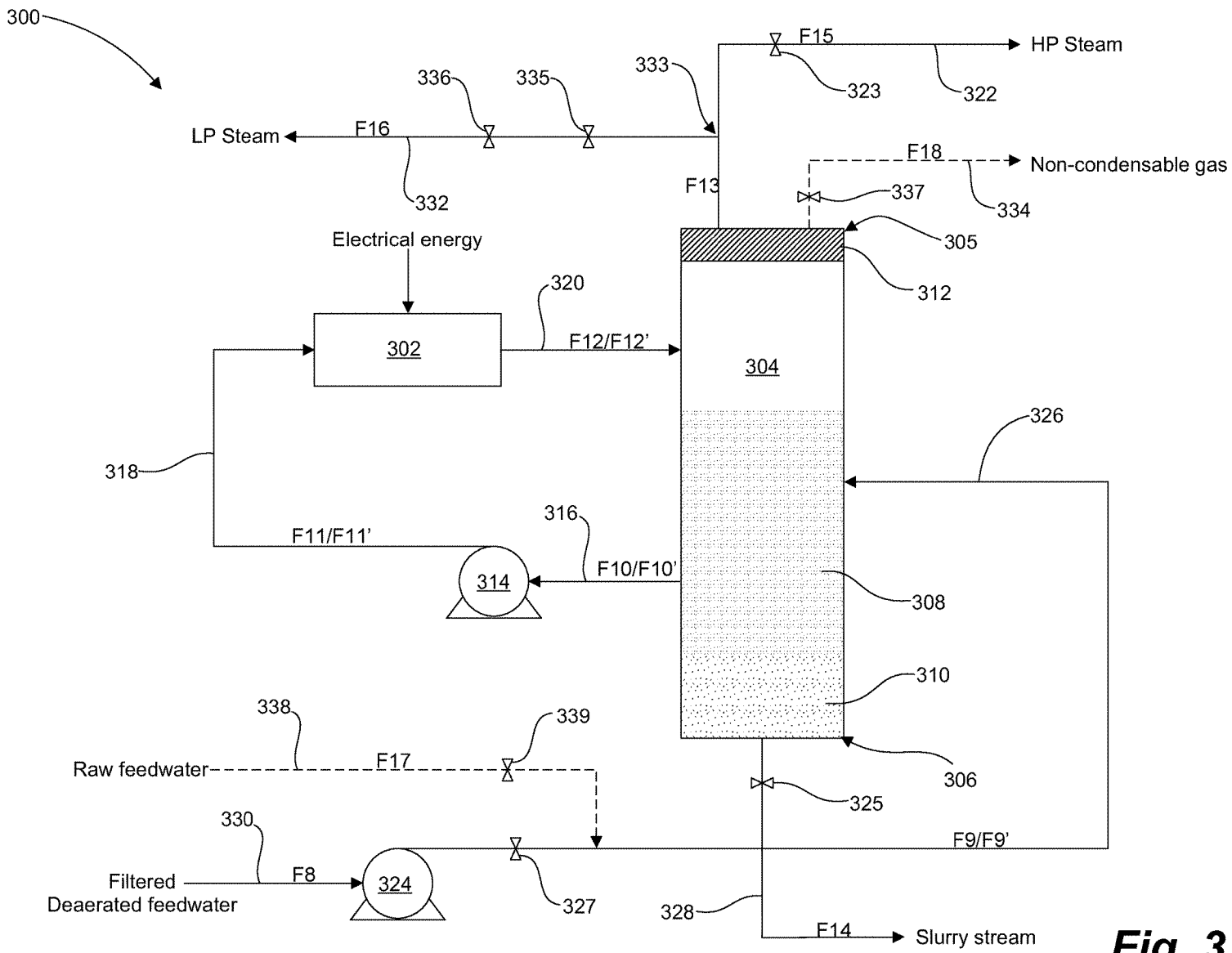
FIG. 3 is a process flow diagram of another example system, according to some embodiments.

Another example system 300 is shown in FIG. 3. In this example, the feedstream is a feedwater and the vapor to be generated is steam.

In this embodiment, the system 300 comprises an ohmic heating device 302 in fluid communication with a flash vessel 304. The ohmic heating device 302 and the flash vessel 304 may be similar to the ohmic heating device 102 and flash vessel 104 of FIG. 1A as described above.

The flash vessel 304 has an upper end 305 and a lower end 306. The flash vessel 304 may comprise a flash inlet, a liquid inlet, a liquid outlet, a vapor outlet, and a slurry outlet (not shown) similar to the flash inlet 111, the liquid inlet 113, the liquid outlet 115, the vapor outlet 117, and the slurry outlet 119 of the system 100. The flash vessel 304 may have a liquid brine phase 308 and a slurry phase 310 therein. In some embodiments, the flash vessel 304 may further comprise a mist eliminator 312.

In this embodiment, a primary fluid conduit 322 extends from the vapor outlet (not shown) of the flash vessel 304. The primary fluid conduit 322 may have a junction 333 interconnecting the primary fluid conduit 322 with a secondary fluid conduit 332. In some embodiments, a valve 323 may be in fluid communication with the primary fluid conduit 322 to control the flow of fluid therethrough. In some embodiments, at least one valve may be in fluid communication with the secondary fluid conduit 332. In this embodiment, a first valve 335 and a second valve 336 are in fluid communication with the secondary fluid conduit 332. The first valve 335 may control the flow of fluid through the secondary fluid conduit 332 and the second valve 336 may comprise a pressure-reducing valve to reduce the pressure of the fluid flowing therethrough.

In this embodiment, the flash vessel 304 further comprises a gas outlet (not shown) at the upper end 305 of the flash vessel 304. In some embodiments, another fluid conduit 334 may be provided, extending from the gas outlet. The fluid conduit 334 may be used to vent non-condensable gas (NCG) from the flash vessel 304. As used herein, a "non-condensable" gas refers to a gas that is soluble in water but does not condense under the conditions where the product steam may be used. The non-condensable gas may comprise oxygen, carbon dioxide, and/or any other non-condensable gas that may be exsolved from secondary feedstream F17 as described in more detail below. In some embodiments, a valve 337 may be in fluid communication with the fluid conduit 334 to control the flow of NCG therethrough. As described below, non-condensable gases may be vented when the system 300 is operated in the cold-start mode.

The system 300 may further comprise a first pump 314 and a second pump 324, similar to the first pump 114 and the and second pump 124 of FIG. 1A, respectively. The system 300 may further comprise fluid conduits 316, 318, 320, 326, 328, and 330 and valves 325 and 327 that are similar to fluid conduits 116, 118, 120, 126, 128, and 130 and valves 125 and 127 of FIG. 1A, respectively.

In this embodiment, another fluid conduit 338 may be provided in fluid communication with the second pump 324 and the flash vessel 304. In some embodiments, the fluid conduit 338 is fluidly connected to the fluid conduit 326 which in turn fluidly connects the second pump 324 to the flash vessel 304. In some embodiments, a valve 339 may be in fluid communication with the fluid conduit 338 to control the flow of fluid therethrough.

In this embodiment, the system 300 may receive a primary feedstream F8 via the fluid conduit 330. In this embodiment, the primary feedstream F8 comprises filtered, deaerated feedwater. The feedwater may be filtered and deaerated at an upstream feedstream processing system, such as the upstream feedstream processing system 500 shown in FIG. 5 and described in more detail below.

In some embodiments, a secondary feedstream F17 may be provided via the fluid conduit 338. In this embodiment, the secondary feedstream F17 comprises raw feedwater. As used herein, "raw feedwater" may refer to feedwater that has not been deaerated. In some embodiments, the raw feedwater has been filtered. In other embodiments, the raw feedwater is not filtered. As the raw feedwater has not been deaerated, the secondary feedstream F17 may not be preheated and may be at a lower temperature than the primary feedstream F8. In some embodiments, the secondary feedstream F17 may be used when the system 300 is operated in the cold-start mode as described below.

During normal operation, the valve 339 may be closed and only the primary feedstream F8 may be received into the system 300. The primary feedstream F8 may be received by the second pump 324 via the fluid conduit 330. The second pump 324 may pressurize the primary feedstream F8 and pump a pressurized feedstream F9 to the flash vessel 304 via the fluid conduit 326. The pressurized feedstream F9 may then combined with the liquid brine phase 308 in the flash vessel 304.

The first pump 314 may withdraw a stream F10 of liquid brine from the liquid brine phase 308 of the flash vessel 304 via the fluid conduit 316. The first pump 314 may pressurize the stream F10 and pump a stream F11 of over-pressurized brine to the ohmic heating device 302 via the fluid conduit 318.

The ohmic heating device 302 may heat the stream F11 to produce a stream F12 of over-heated, over-pressurized brine. The fluid conduit 320 may convey the stream F12 to the flash vessel 304. The stream F12 may be flashed in the flash vessel 304 to a vapor portion and a remaining liquid portion. The remaining liquid portion may enter the liquid brine phase 308. At least a portion of the dissolved solids in the stream F12 may precipitate into the slurry phase 310. A slurry stream F14 may be withdrawn from the flash vessel 304 via the fluid conduit 328 for further processing and/or disposal.

The vapor portion may be demisted by the mist eliminator 312 and a vapor stream F13 may be withdrawn from the flash vessel 304 via the primary fluid conduit 322. In some embodiments, the vapor stream F13 may be split at the junction 333 into a primary vapor stream F15 and a secondary vapor stream F16. The primary vapor stream F15 may continue to flow through the primary fluid conduit 322 and the secondary vapor stream F16 may flow through the secondary fluid conduit 332. In some embodiments, the pressure of the secondary vapor stream F16 may be reduced by the second valve 336.

Therefore, in some embodiments, the primary fluid stream F15 may comprise high-pressure steam and the secondary fluid stream F16 may comprise low-pressure steam. Depending on the desired output of the system 300, the valves 323 and 335 may be opened or closed to produce high-pressure steam, low-pressure steam, or both, via the system 300. When the valve 323 is open and the valve 335 is closed, only the primary fluid stream F15 (i.e. high-pressure steam) is produced. When the valve 323 is closed and the valve 335 is open only the secondary fluid stream F16 (i.e. low-pressure steam) is produced. When both valves 323 and 335 are open, both the primary and secondary fluid streams F15, F16 are produced.

In some embodiments, the system 300 comprises a control system (not shown). The control system may be configured to implement embodiments of the methods described herein. In some embodiments, the system 300 may be operated continuously or intermittently similar to the system 100 of FIG. 1A as described above.

In some embodiments, the system 300 may be operated in a stand-by mode and a start-up mode. In some embodiments, the stand-by mode of the system 300 is similar to the stand-by mode of the system 100. In this embodiment, in the stand-by mode, valves 323, 325, 327, 335, 337, and 339 may all be closed.

In the start-up mode, the first pump 314 and the ohmic heating device 302 may be operated continuously at a constant or increasing rate of electrical power input until the pressure of the flash vessel 304 reaches the desired operating pressure and the temperature to allow flash cooling of the stream F12 to occur. Once flash cooling occurs in the flash vessel 304, the vapor stream F13 may be withdrawn from the flash vessel 304. In some embodiments, the valve 335 is open and the valve 323 may be opened or closed such that the secondary vapor stream F16 and, optionally, the primary vapor stream F15 are produced. The secondary vapor stream F16 may flow through the pressure reducing valve 336 to produce low-pressure steam. In some embodiments, the low-pressure steam may be directed to a deaerator of the upstream feedstream processing system to bring the deaerator up to its required operating temperature such that the primary feedstream F8 can be supplied to the system 300 again.

The start-up mode may then continue as described for system 100 above. At the end of the start-up mode, the valves 323, 325, and 327 may be opened and the valves 337 and 339 may be closed. The valve 335 may be opened or closed depending on whether or not supplementary low-pressure steam is still being directed to the deaerator.

In other embodiments, the system 300 may operate in a "cold start-up" mode without operating in a preceding stand-by mode. The cold start-up mode may comprise using the flash vessel 304 and the ohmic heating device 302 to deaerate and pre-heat the secondary feedstream F17. In the cold start-up mode, the valve 327 may be closed and the valve 339 may be opened to allow the secondary feedstream F17 to be pumped through the fluid conduit 326. In some embodiments, the secondary feedstream F17 is pressurized via the second pump 324 to produce a pressurized secondary feedstream F9', which is fed into the flash vessel 304. The pressurized secondary feedstream F9' may be at a pressure suitable for effective deaeration thereof within the flash vessel 304. During deaeration of the pressurized feedstream F9', exsolved non-condensable gases, such as oxygen and carbon dioxide, may accumulate in the flash vessel 304 proximate the upper end 305. In some embodiments, the valve 337 may be opened to allow a stream F18 of non-condensable gases to be vented from the flash vessel 304 via the fluid conduit 334. In some embodiments, the valve 337 may operate with a controlled back pressure approximately matching that required for effective deaeration of the pressurized secondary feedstream F9'. In some embodiments, the valves 323 and 335 may be closed such that no vapor stream F13 is withdrawn and the valve 325 may be closed such that no slurry stream F14 is withdrawn when the system 300 is in the cold start-up mode.

The deaerated feedstream (not shown) may enter the liquid brine phase 308 and may raise the volume of the liquid brine phase 308. A stream F10' of liquid brine (at least partially comprised of the deaerated feedstream) may then be withdrawn and pressurized via the first pump 314 to produce a stream F11' of pressurized liquid brine. The stream F11' may be heated in the ohmic heating device 302 to produce a stream F12' of heated, pressurized liquid brine that may be introduced into the flash vessel 304. In some embodiments, brine circulation, ohmic heating, and addition of the secondary feedstream F17 may continue until the liquid brine phase 308 reaches its maximum volume. Thereafter, the system 300 may transition to normal operation or to the stand-by mode described above.

Figure 4:
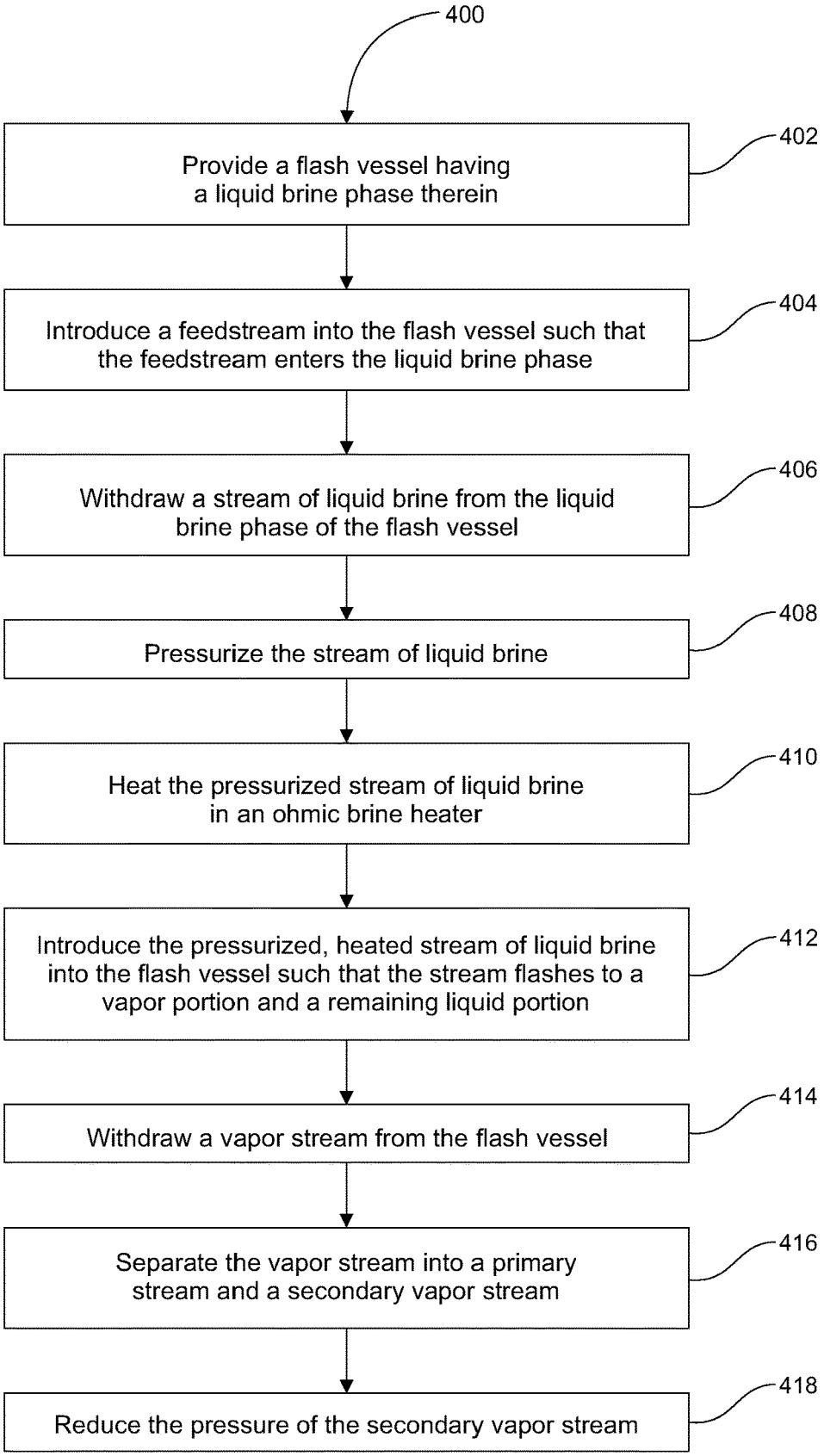
FIG. 4 is a flowchart of an example method for generating a vapor, implemented using the system of FIG. 3, according to some embodiments.

FIG. 4 is a flowchart of another example method 400 for generating a vapor, implemented using the system 300 of FIG. 3.

At block 402, a flash vessel 304 is provided having a liquid brine phase 308 therein and operating at a first pressure and a first temperature. The steps at block 402 may be similar to the steps at block 202 of FIG. 2, as described above.

At block 404, a feedstream is introduced into the flash vessel 304 such that the feedstream enters the liquid brine phase 308. In some embodiments, the feedstream is a primary feedstream comprising filtered, deaerated feedwater. In some embodiments, the feedstream may be at or above the first pressure.

The steps at blocks 406, 408, 410, 412, and 414 may be similar to the steps at blocks 206, 208, 210, 212, and 214 of FIG. 2 as described above. Briefly, at block 406, a stream of liquid brine is withdrawn from the liquid brine phase 308 of the flash vessel 304. At block 408, the stream of liquid brine is pressurized to a second pressure and at block 410 the pressurized stream of liquid brine is heated in the ohmic heating device 302 to a second temperature, the second pressure and temperature being higher than the first pressure and temperature. At block 412, the pressurized, heated stream of liquid brine is introduced into the flash vessel 304 such that the pressurized, heated stream flashes to a vapor portion and a remaining liquid portion, the remaining liquid portion being at the first pressure and the first temperature and entering the liquid brine phase 308. At block 414, a vapor (steam) stream may be withdrawn from the flash vessel 304.

At block 416, the vapor stream is separated into a primary vapor stream and a secondary vapor stream. In some embodiments, the vapor stream is separated via the junction 333 in the primary fluid conduit 322.

At block 418, the pressure of the secondary vapor stream is reduced. In some embodiments, the pressure of the secondary vapor stream is reduced via the pressure reducing valve 336. Therefore, in some embodiments, the primary vapor stream may have a first pressure and the secondary vapor stream may have a second pressure, the second pressure being lower than the first pressure.

In some embodiments, the primary vapor stream comprises high-pressure steam. For example, the high-pressure steam may have a pressure of about 5 MPa to about 10 MPa. In some embodiments, the secondary vapor stream may comprise low-pressure steam. For example, the low-pressure steam may have a pressure of about 0.2 MPa to about 5 MPa.

In some embodiments, the primary vapor stream may be directed to one or more downstream facilities for use and/or further processing. In some embodiments, the primary vapor stream may be used in a thermal oil recovery process, for example, a SAGD process or a CSS process. In some embodiments, at least a portion of the primary vapor stream may be injected via at least one injection well into a subterranean reservoir as part of the thermal oil recovery process.

In some embodiments, the secondary vapor stream may be directed to one or more downstream facilities for use and/or further processing. In some embodiments, the secondary vapor stream may be directed to a deaerator in the upstream feedstream processing system, as described in more detail with respect to FIG. 5 below.

Other variations are also possible. In some embodiments, only the primary vapor stream may be withdrawn from the flash vessel 304, for example, when the valve 335 is closed and the valve 323 is open. In other embodiments, only the secondary vapor stream may be withdrawn from the flash vessel 304, for example, when the valve 323 is closed and the valve 335 is open.

In some embodiments, the method 400 further comprises withdrawing a slurry stream as described above for the method 200 of FIG. 2.

In some embodiments, the steps at blocks 404 to 418 may be repeated in as many cycles as required to produce a desired volume of high-pressure and/or low-pressure steam over time. In some embodiments, the steps at blocks 404 to 418 may be repeated continuously. In other embodiments, the steps at blocks 404 to 418 may be repeated intermittently.

In some embodiments, when the system 300 is in the stand-by mode, the steps at blocks 406 to 410 may be repeated. The steps at blocks 406 to 410 may be performed at a lower pressure and temperature such that the stream of liquid brine is introduced into the flash vessel 304 without undergoing flash cooling. The flash vessel 304 may thereby be maintained at a desired pressure and temperature, as described above with respect to the method 200.

In some embodiments, when the system 300 is in the start-up mode, the steps at blocks 406 to 418 may be repeated. In some embodiments, the low-pressure steam produced at block 418 may then be directed to a deaerator in the upstream feedstream processing system to allow the deaerator to start deaerating the primary feedstream. The operation of the deaerator is described in more detail below with reference to FIG. 5.

In some embodiments, when the system 300 is in the cold start-up mode, the method 400 may further comprise introducing a secondary feedstream comprising raw feedwater into the flash vessel 304. The secondary feedstream may be introduced into the flash vessel 304 at a suitable pressure for deaeration of at least a portion of the secondary feedstream. The secondary feedstream may enter the liquid brine phase 308 and raise the volume thereof. As the secondary feedstream is deaerated, at least a portion of the exsolved gases may be vented from the flash vessel 304. The steps at blocks 406 to 410 may then be repeated at a lower pressure and temperature such that the stream of liquid brine may be introduced into the flash vessel 304 without undergoing flash cooling. The preceding steps may be repeated until the liquid brine phase 308 reaches its maximum volume.

Figure 5:
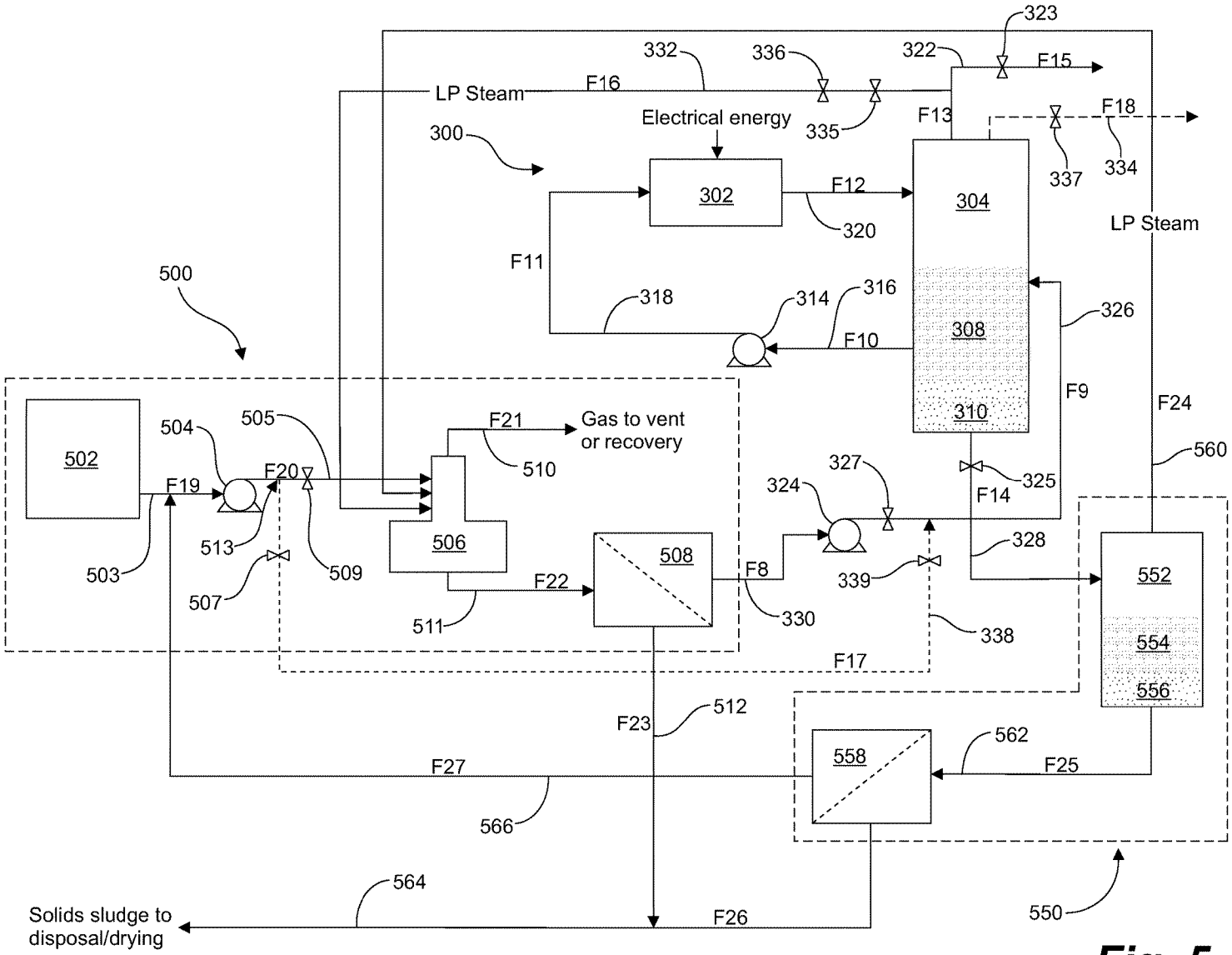
FIG. 5 is a process flow diagram of the system of FIG. 3, shown in combination with an upstream feedstream processing system and a downstream slurry processing system, according to some embodiments.

FIG. 5 shows the system 300 of FIG. 3 in combination with an upstream feedstream processing system 500 and a downstream slurry processing system 550, according to some embodiments. In this example, the feedstream is a feedwater comprising dissolved solids therein and the vapor being generated is steam.

As shown in FIG. 5, the feedstream processing system 500 in this embodiment comprises a feedwater storage vessel 502, a deaerator 506, and a solids separator 508. In other embodiments, the system 500 may only comprise the deaerator 506 and solids separator 508, without the feedwater storage vessel 502, if the feedwater may be provided to the system 500 by some other means.

The feedwater storage vessel 502 may be configured to store raw feedwater. The feedwater storage vessel 502 may comprise any suitable storage vessel to store the raw feedwater therein. In some embodiments, the feedwater storage vessel 502 stores the raw feedwater at atmospheric pressure. The feedwater storage vessel 502 may be in fluid communication with the deaerator 506.

The deaerator 506 may be configured to deaerate the raw feedwater. As used herein, "deaerate" refers to removing at least a portion of dissolved gases from the raw feedwater. The dissolved gases may comprise oxygen, carbon dioxide, and/or any other dissolved gases in the raw feedwater. The deaerator 506 may be any suitable type of deaerator. As one example, the deaerator 506 may comprise a tray-type deaerator. In this embodiment, the deaerator 506 deaerates the feedwater by contacting the feedwater with low-pressure steam. In other embodiments, the deaerator 506 may deaerate the feedwater by any suitable means.

In some embodiments, the deaerator 506 may comprise a gas outlet (not shown). A fluid conduit 510 may extend from the gas outlet. The gas outlet and the fluid conduit 510 may be used to vent dissolved gasses removed from the feedwater during aeration.

In some embodiments, the deaerator 506 is in fluid communication with the feedwater storage vessel 502 via a pump 504. In some embodiments, the pump 504 is a low-pressure pump. In other embodiments, the pump 504 is any other suitable type of pump. In this embodiment, the pump 504 is fluidly connected to the feedwater storage vessel 502 via a fluid conduit 503 and fluidly connected to the deaerator 506 via another fluid conduit 505.

In some embodiments, a valve 509 may be in fluid communication with the fluid conduit 505 to control the flow of fluid therethrough. The valve 509 may be opened during normal operation of the system 300 and closed when the system 300 is in the cold start-up mode as described above.

In some embodiments, the fluid conduit 505 between the pump 504 and the deaerator 506 further comprises a junction 513. In this embodiment, the junction 513 interconnects the fluid conduit 505 with the fluid conduit 338 of system 300. The secondary fluid conduit 338 may convey the secondary feedstream F17 to the flash vessel 304 as described above. Therefore, in this embodiment, the secondary feedstream F17 comprises raw feedwater directly from the feedwater storage vessel 502. In some embodiments, another valve 507 is in fluid communication with the fluid conduit 338 to control the flow of the secondary feedstream F17 therethrough. In some embodiments, the valve 507 is closed during normal operation of the system 300 and open when the system 300 is in the cold-start up mode as described above.

The deaerator 506 may be in fluid communication with the flash vessel 304 of the system 300. In this embodiment, the deaerator 506 is fluidly connected to the flash vessel 304 via the secondary fluid conduit 332. Therefore, in some embodiments, low-pressure steam may be provided to the deaerator by the secondary vapor stream F16, withdrawn from the flash vessel 304. Other sources of low-pressure steam will be discussed in more detail below.

The deaerator 506 may also be in fluid communication with the solids separator 508. In this embodiment, the deaerator 506 is fluidly connected to the solids separator 508 via a fluid conduit 511. The solids separator 508 may be configured to separate at least a portion of precipitated and/or suspended solids from deaerated feedwater passing therethrough. In some embodiments, the solids separator 508 comprises a filtration device. In other embodiments, the solids separator 508 may comprise any other suitable separation device. In some embodiments, the solids separator 508 comprises a sludge outlet (not shown). A fluid conduit 512 may extend from the sludge outlet to withdraw separated solids from the solids separator 508.

The solids separator 508 may be in fluid communication with the second pump 324 of the system 300. In this embodiment, the solids separator 508 is fluidly connected to the pump 324 via the fluid conduit 330.

In operation, a stream F19 of raw feedwater may be withdrawn from the feedwater storage vessel 502 by the pump 504 via the fluid conduit 503. The pump 504 may pressurize the stream F19 to produce a stream F20 of pressurized raw feedwater. In embodiments in which the pump 504 is a low-pressure pump, the stream F20 is pressurized to a relatively low pressure. The pump 504 may pump the stream F20 to the deaerator 506 via the fluid conduit 505.

The deaerator 506 may deaerate the stream F20 of pressurized raw feedwater to produce a stream F22 of deaerated feedwater. In some embodiments, the deaerator 506 may deaerate the stream F20 by contacting the stream F20 with low-pressure steam. In some embodiments, the low-pressure steam is received from the flash vessel 304 via the secondary fluid conduit 332. Contacting the stream F20 with the low-pressure steam may also increase its temperature such that the stream F22 of deaerated feedwater is at a higher temperature than the stream F20. In some embodiments, a stream F21 of dissolved gases removed from the stream F20 during deaeration may be released from the deaerator 506 via the fluid conduit 510. The gases may be vented or sent to a suitable recovery system.

The solids separator 508 may receive the stream F22 of deaerated feedwater from the deaerator 506 via the fluid conduit 511. The stream F22 may pass through the solids separator 508 to produce the feedstream F8 of filtered, deaerated feedwater for the system 300 as described above. The feedstream F8 may be supplied to the second pump 324 of the system 300 via the fluid conduit 330. In some embodiments, a sludge stream F23 comprised of concentrated solids may be withdrawn from solids separator 508 via the fluid conduit 512. In some embodiments, the stream F23 may then be directed to a solids disposal system (not shown). In some embodiments, the sludge stream F23 is dried prior to disposal.

FIG. 5 also shows the downstream processing system 550. The downstream slurry processing system 550 in this embodiment comprises a flash vessel 552 and a solids separator 558. Hereafter, the flash vessel 304 of the system 300 will also be referred to as the primary flash vessel 304 and the flash vessel 552 of the downstream slurry processing system 550 will also be referred to as the secondary flash vessel 552.

In some embodiments, the secondary flash vessel 552 may be similar to the primary flash vessel 304, although the secondary flash vessel 552 may have a smaller internal volume. The secondary flash vessel 552 may comprise a flash inlet, a vapor outlet, and a slurry outlet (not shown). The secondary flash vessel 552 may have a liquid brine phase 554 and a slurry phase 556 therein. In some embodiments, the secondary flash vessel 552 is operated in a similar manner to the primary flash vessel 304 but at a lower operating pressure and temperature than the primary flash vessel 304.

The secondary flash vessel 552 may be in fluid communication with the primary flash vessel 304. In this embodiment, the secondary flash vessel 552 is fluidly connected with the primary flash vessel 304 via the fluid conduit 328. The fluid conduit 328 may extend from the slurry outlet of the primary flash vessel 304 to the flash inlet of the secondary flash vessel 552.

The secondary flash vessel 552 may also be in fluid communication with the deaerator 506 of the feedstream processing system 500. In this embodiment, the secondary flash vessel 552 is fluidly connected to the deaerator 506 via a fluid conduit 560. The fluid conduit 560 may extend from the vapor outlet of the secondary flash vessel 552 to the deaerator 506.

The secondary flash vessel 552 may also be in fluid communication with the solids separator 558. In this embodiment, the secondary flash vessel 552 is fluidly connected to the solids separator 558 by a fluid conduit 562. The fluid conduit 562 may extend from the slurry outlet of the secondary flash vessel 552 to the slurry inlet (not shown) of the solids separator 558.

The solids separator 558 may be similar to the solids separator 508 of the feedstream processing system 500. In some embodiments, the solids separator 508 has a smaller capacity than that of the solids separator 508. The solids separator 558 may comprise a slurry inlet, a liquid outlet, and a sludge outlet (not shown).

The solids separator 558 may be in fluid communication with the pump 504 of the feedstream processing system 500. In this embodiment, a fluid conduit 566 extends from the liquid outlet of the solids separator 558 and fluidly connects to the fluid conduit 503 that delivers the raw feedwater to the pump 504 of the system 500.

In operation, flash cooling may occur in the primary flash vessel 304 as described above and the slurry stream F14 may be withdrawn via the slurry outlet (not shown). The slurry stream F14 may be conveyed from the primary flash vessel 304 to the secondary flash vessel 552 via the fluid conduit 328. The slurry stream F14 may be introduced into the secondary flash vessel 552 via the flash inlet. As the secondary flash vessel 552 is at a lower pressure and temperature than the primary flash vessel 304, the slurry stream F14 may undergo flash cooling as the slurry stream F14 is introduced into the secondary flash vessel 552. The slurry stream F14 may thereby flash into a vapor portion and a remaining liquid portion, the remaining liquid portion being at the pressure and temperature of the secondary flash vessel 552 and entering the liquid brine phase 554 therein. Precipitated solids may settle into the slurry phase 556.

In some embodiments, a vapor stream F24 may be withdrawn from the secondary flash vessel 552 via the vapor outlet and the fluid conduit 560. The vapor stream F24 may comprise low-pressure steam due to the lower operating pressure of the secondary flash vessel 552. In some embodiments, the vapor stream F24 may be conveyed from the secondary flash vessel 552 to the deaerator 506 of the feedstream processing system 500 via the fluid conduit 560. The vapor stream F24 may thereby be introduced into the deaerator 506 to provide a source of low-pressure steam to deaerate the stream F20 of pressurized raw feedwater.

In some embodiments, a second slurry stream F25 may be withdrawn from the secondary flash vessel 552 via the slurry outlet and the fluid conduit 562. The solids separator 558 may separate the second slurry stream F25 into a sludge stream F26 of concentrated solids and a stream F27 of liquid brine.

The sludge stream F26 may be withdrawn from the solids separator 558 via the fluid conduit 564. In some embodiments, the fluid conduit 564 may convey the sludge stream F26 to a disposal system (not shown). In some embodiments, the fluid conduit 564 is fluidly connected with the fluid conduit 512 extending from the solid separator 508 of the feedstream processing system 500 such that the sludge streams F23 and F26 combine as they are conveyed to the disposal system.

The stream F27 of liquid brine may be withdrawn from the solids separator 558 via the fluid conduit 566. In some embodiments, the fluid conduit 566 may convey the stream F27 to the fluid conduit 503 that delivers the raw feedwater to the pump 504 of the feedstream processing system 500. The stream F27 of liquid brine may thus be combined with the stream F19 of raw feedwater, thereby ultimately forming part of the feedstream F8 that is used to generate steam via the system 300. Combining the stream F27 of liquid brine with the feedstream F8 may function to pre-heat the feedstream F8 as the stream F27 will be at or slightly below the temperature of the secondary flash vessel 552. In other embodiments, the fluid conduit 566 may deliver the stream F27 to any other suitable location for use and/or further processing.

Therefore, in some embodiments, the ohmic heating device 302 of system 300 may be used as the sole source of thermal energy for the combination of systems 300, 500, and 550 as shown in FIG. 5. The deaerator 506 may receive low-pressure steam from either the primary flash vessel 304 or the secondary flash vessel 552, thereby eliminating the need for an additional source of steam. This configuration may be particularly useful if the system 300 is used as a stand-alone source of steam for a thermal oil recovery operation.

In other embodiments, if the system 300 is used as a supplementary source of steam in combination with a conventional steam generation system, the conventional steam generation system may be used to provide low-pressure steam to the deaerator 506.

Figure 6:
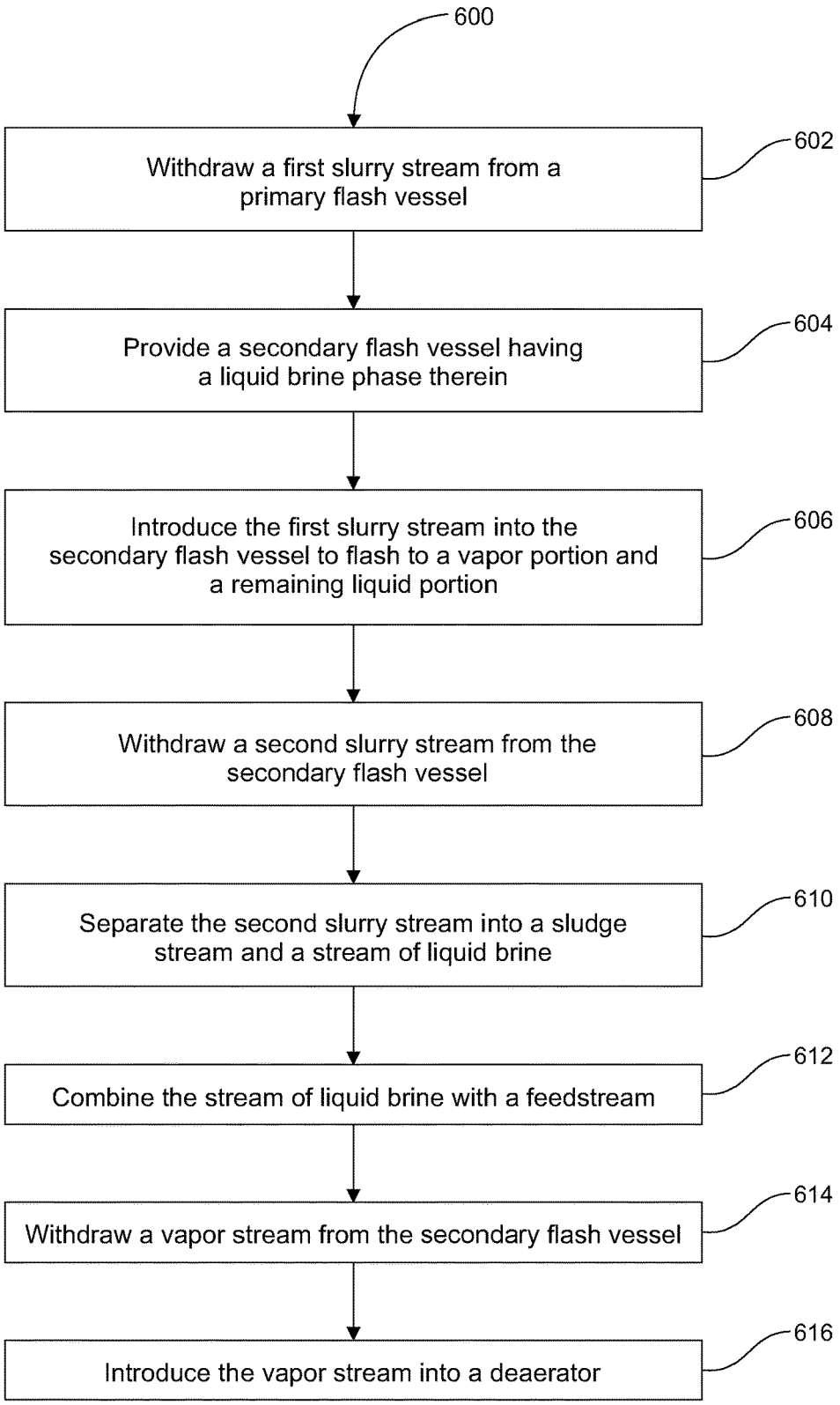
FIG. 6 is a flowchart of an example method including additional steps for processing a slurry stream, implemented using the systems of FIG. 5, according to some embodiments.

FIG. 6 is a flowchart of another example method 600, implemented using the systems 300, 500, and 550 of FIG. 5. The steps in the method 600 may be performed after the steps of the methods 200 or 400 are performed as described above.

At block 602, a first slurry stream is withdrawn from a primary flash vessel 304. The primary flash vessel 304 may have a first temperature and a first pressure as described above.

At block 604, a secondary flash vessel 552 is provided having a liquid brine phase 554 therein. The secondary flash vessel may have a third temperature and third pressure, the third temperature and the third pressure being lower than the first temperature and the first pressure. In some embodiments, the third pressure is about 0.2 MPa to 1.5 MPa. In some embodiments, the third temperature is about 125° C. to 205° C. In other embodiments, the third temperature and the third pressure may be any other suitable temperature and pressure.

At block 606, the first slurry stream is introduced into the secondary flash vessel 552 to flash the first slurry stream to a vapor portion and a remaining liquid portion, the remaining liquid portion being at the third pressure and the third temperature and entering the liquid brine phase 554 of the secondary flash vessel 552. At least a portion of the dissolved solids in the first slurry stream may precipitate and enter the slurry phase 556.

At block 608, a second slurry stream is withdrawn from the secondary flash vessel 552.

At block 610, the second slurry stream is separated into a sludge stream of concentrated solids and a stream of liquid brine. In some embodiments, the second slurry stream is separated in the solids separator 558. In some embodiments, the sludge stream is withdrawn to be dried and disposed.

At block 612, the stream of liquid brine is combined with a feedstream for the primary flash vessel 304. The feedstream may be used in the methods 200 or 400 as described above. In some embodiments, the stream of liquid brine is combined with the feedstream prior to the feedstream being deaerated and/or filtered. In some embodiments, the stream of liquid brine may pre-heat the feedstream prior to the feedstream being introduced into the primary flash vessel 304. However, it will be understood that the steps at blocks 610 and 612 are optional and may be omitted in some embodiments.

At block 614, a vapor stream is withdrawn from the secondary flash vessel 552. In some embodiments, the vapor stream comprises low-pressure steam.

At block 616, the vapor stream is introduced into a deaerator 506. The deaerator 506 may thereby use the vapor stream as a source of low-pressure steam to deaerate the feedstream prior to the feedstream being introduced into the primary flash vessel 304.

Therefore, the method 600, implemented using the systems 300, 500, and 550, may allow integrated steam generation and water treatment in embodiments in which the ohmic heating device 302 of the system 300 is the only source of thermal energy.

As discussed above, in some embodiments, the feedwater may comprise "minimally treated" produced water from a thermal oil recovery operation. FIG. 7 shows an example system 700 for producing minimally treated produced water for use as a feedwater for the systems 100 or 300 as described above.

In some embodiments, the thermal oil recovery process is SAGD, CSS, or steam flooding. In other embodiments, the thermal oil recovery process is any other suitable thermal oil recovery process in which steam is used. The produced fluids from the thermal oil recovery process may comprise a hot pressurized mixture of oil, water, and dissolved and/or free gas. Typically, the gas comprises methane or carbon-dioxide that was dissolved in the oil under virgin reservoir conditions as well as minor portions of the most volatile components of the oil. Therefore, in some embodiments, the system 700 may function to: separate free and/or dissolved gas from the pressurized hot oil and water; separate the oil from the water; and provide separate streams of cooled oil and water that are each in liquid phase at atmospheric pressure. The stream of water may thereby be used as the feedwater for the systems 100 or 300.

As shown in FIG. 7, the system 700 in this embodiment comprises a gas/liquid separator 702, a free water knockout (FWKO) vessel 704, at least one oil treater 706, and a flash vessel 710. In this embodiment, the system 700 further comprises a feedwater storage vessel 712. In other embodiments, the system 700 may be fluidly connected to the feedwater storage vessel 502 of the upstream feedstream processing system 500 of FIG. 5. In other embodiments, the feedwater storage vessel 712 and the feedwater storage vessel 502 of FIG. 5 may be one and the same.

The gas/liquid separator 702 may be configured to separate at least a portion of free gas from a stream of produced fluid from a thermal oil recovery process. As one example, the gas/liquid separator 702 may comprise a spray tower. In some embodiments, the gas/liquid separator 702 separates approximately all of the free gas from the stream of produced fluid. The gas/liquid separator 702 may be in fluid communication with the FWKO vessel 704. In this embodiment, the gas/liquid separator 702 is fluidly connected to the FWKO vessel 704 via a fluid conduit 714.

The FWKO vessel 704 may be configured to separate at least a portion of the water from a stream of de-gassed produced fluids received from the gas/liquid separator 702. As one example, the FWKO vessel 704 may comprise a gravity decanter. In some embodiments, the FWKO vessel 704 separates approximately all of the free water from the de-gassed produced fluids; excluding water that is incorporated as finely dispersed droplets within the oil (i.e. as a water-in-oil emulsion). The FWKO vessel 704 may thereby generate an oil stream, a gas stream, and a water stream. The FWKO vessel 704 may be in fluid communication with the flash vessel 710. In this embodiment, the FWKO vessel 704 is fluidly connected to the flash vessel 710 via a fluid conduit 720, which extends from the FWKO vessel 704 to a flash inlet (not shown) of the flash vessel 710.

The FWKO vessel 704 may also be in fluid communication with the oil treater 706. In this embodiment, the FWKO vessel 704 is in fluid communication with the oil treater 706 via a first heat exchanger 705. A fluid conduit 716 may fluidly connect the FWKO vessel 704 to the first heat exchanger 705 and another fluid conduit 718 may fluidly connect the first heat exchanger 705 to the oil treater 706.

At least one oil treater 706 may be configured to separate at least a portion of the dispersed water droplets from the oil stream received from the FWKO vessel 704. Non-limiting examples of a suitable oil treater include a gravity decanter, a cyclone, and a centrifuge. In some embodiments, the oil treater 706 reduces the residual water content of the oil to below a specified value, for example below about 0.5 wt %. The oil treater 706 may be in fluid communication with the flash vessel 710. In this embodiment, a fluid conduit 722 extends from the oil treater 706 to fluidly connect to the fluid conduit 720, which in turn fluidly connects the FWKO vessel 704 and the flash vessel 710.

The flash vessel 710 may be configured to flash the water received from the FWKO vessel 704 and the oil treater 706. The flash vessel 710 may be any suitable type of flash vessel, including any of the flash vessels described herein or any conventional type of flash vessel. The flash vessel 710 may comprise a flash inlet, a liquid outlet, a vapor outlet, and a slurry outlet (not shown). The flash vessel 710 may be in fluid communication with the feedwater storage vessel 712. In this embodiment, the flash vessel 710 is fluidly connected to the feedwater storage vessel 712 via a fluid conduit 724 extending from the liquid outlet of the flash vessel 710 to the feedwater storage vessel 712. Another fluid conduit 730 may extend from the slurry outlet of the flash vessel 710 to convey slurry or sludge therefrom.

In some embodiments, another fluid conduit 726 may extend from the vapor outlet of the flash vessel 710 to a second heat exchanger 707. The second heat exchanger 707 may condense the vapor generated by the flash vessel 710 to liquid. The second heat exchanger 707 may also be in fluid communication with the feedwater storage vessel 712. In this embodiment, a fluid conduit 728 extends from the second heat exchanger 707 and fluidly connects to the fluid conduit 724, which in turn fluidly connects the flash vessel 710 and the feedwater storage vessel 712.

In operation, the system 700 may function as follows. The gas/liquid separator 702 may receive a stream F30 of produced fluids from the thermal oil recovery process and at least partially de-gas the stream F30 to produce a stream F32 of de-gassed produced fluids. A stream F31 of gas may be withdrawn from the gas/liquid separator 702 via a fluid conduit 713 and sent to a gas recovery unit (not shown). In some embodiments, the stream F32 of de-gassed produced fluids may have a temperature of approximately 175° C. at this stage.

The FWKO vessel 704 may receive the stream F32 of de-gassed produced fluids and may separate the stream F32 into a first oil stream F33, a first water stream F34, and a second gas stream F35. In some embodiments, the second gas stream F35 may be withdrawn from the FWKO vessel 704 via a fluid conduit 715 and may combine with the stream F31 in the fluid conduit 713 to be sent to the gas recovery unit.

In some embodiments, the first water stream F34 may be conveyed to the flash vessel 710 via the fluid conduit 720. In some embodiments, the temperature of the first water stream F34 is approximately 175° C. at this stage.

In some embodiments, the first oil stream F33 may pass through the first heat exchanger 705 via the fluid conduit 716. In some embodiments, the first heat exchanger 705 may lower the temperature of the first oil stream F33 to approximately 130° C. The first oil stream F33 may then be conveyed to the oil treater 706 via the fluid conduit 718. In some embodiments, diluent may be introduced into the fluid conduit 718 to combine with the first oil stream F33.

The oil treater 706 may receive the first oil stream F33 and may separate the first oil stream F33 into a second oil stream F36, a second water stream F37, and a third gas stream F46. The second oil stream F36 may be sent downstream for further processing and/or use. In some embodiments, the third gas stream F46 may be withdrawn from the oil treater 706 via a fluid conduit 717 and combined with the first and second gas streams F31 and F35 in the fluid conduit 713 to be sent to the gas recovery unit.

The second water stream F37 may be smaller in volume than the first water stream F34. In some embodiments, the second water stream F37 may be combined with the first water stream F34 in the fluid conduit 720 to form a combined water stream F38. In some embodiments, the second water stream F37 is approximately 130° C. prior to being combined with the first water stream F34. Given the small volume of the second water stream F37, the combined water stream F38 may still have a temperature close to 175° C. In some embodiments, at least one water treatment chemical may be added to the combined water stream F38. In some embodiments, the water treatment chemical comprises magnesium oxide. In other embodiments, the water treatment chemical may comprise any other suitable treatment chemical. Non-limiting examples of other water treatment chemicals include aluminum sulfate, aluminum chloride, aluminum chlorohydrate, ferric and ferrous sulfate, lime, soda ash, caustic, sodium silicate, and polyacrylamide The flash vessel 710 may receive the combined water stream F38 into its flash inlet via the fluid conduit 720. In some embodiments, the flash vessel 710 has a lower operating temperature and lower operating pressure than the combined water stream F38. The combined water stream F38 may thereby flash to a vapor (steam) portion and a remaining liquid (water) portion, the liquid portion being at the operating temperature and pressure of the flash vessel 710. In some embodiments, the flash vessel 710 operates at atmospheric pressure and cools the stream F38 to approximately its boiling point at atmospheric pressure (i.e. to about 100° C.). At least a portion of the dissolved solids in the combined water stream F38 may precipitate in the flash vessel 710 to form a sludge or slurry.

A stream F40 of liquid water, having at least a portion of dissolved solids removed therefrom, may then be withdrawn from the flash vessel 710 via the liquid outlet and the fluid conduit 724. In some embodiments, the stream F40 is delivered to the feedwater storage vessel 712. In some embodiments, a stream F42 of brackish make-up water may also be introduced into the feedwater storage vessel 712 via a fluid conduit 732. A stream F41 of feedwater may then be withdrawn from the feedwater storage vessel 712 via a fluid conduit 734 to be used as the raw feedwater for the systems and methods described above.

In some embodiments, a vapor (steam) stream F39 may be withdrawn from the flash vessel 710 via the vapor outlet and the fluid conduit 726. In some embodiments, the vapor stream F39 is approximately 100° C. at this stage. In some embodiments, the vapor stream F39 may be cooled in the second heat exchanger 707 to produce a stream F43 of condensed, distilled water. In some embodiments, the stream F43 may be combined with the stream F40 of water from the flash vessel 710 and delivered to the feedwater storage vessel 712 via the fluid conduit 724. In some embodiments, the reject heat from the second heat exchanger 707 may be released to the atmosphere. In other embodiments, the reject heat may be used in a low temperature power generation cycle, for example in an ORC (organic Rankine cycle)-based system.

In some embodiments, a slurry or sludge stream F44 may be withdrawn from the flash vessel 710 via the slurry outlet and the fluid conduit 730. In some embodiments, the sludge stream F44 may be sent for disposal. In some embodiments the sludge stream F44 may be combined with one or both of the sludge streams F23 and F26 of the upstream feedstream processing system 500 and downstream slurry processing system 550 of FIG. 5, respectively.

As an optional feature, a fluid conduit 721 may extend from the FWKO vessel 704 and fluidly connect with the fluid conduit 734 which conveys feedwater from the feedwater storage vessel 712. In some embodiments, a pressurized hot water stream F45 may be withdrawn directly from the FWKO vessel 704 via the fluid conduit 721 and may be used as pre-heated deaerated feedwater for the systems and methods described above. In this embodiment, the feedwater is not stored but may be introduced directly upstream of the second pump 124 or 324 of the system 100 or 300, respectively. This configuration may be useful in embodiments in which the system 100 or 300 operates continuously rather than intermittently.

It will be understood to a person skilled in the art that although specific configurations of the systems 100, 300, 500, 550, and 700 are shown in FIGS. 1A, 1B, 3, and 7 and described above, other configurations are possible and embodiments are not limited to the specific configurations provided herein, including the specific number and placement of fluid conduits, valves, etc.

FIGS. 8A and 8B show an example ohmic heating device 802 that may be used in the methods and systems described herein. The ohmic heating device 802 may be used as the ohmic heating device 102 or 302 in systems 100 and 300, respectively, as described above.

As shown in FIG. 8A, the ohmic heating device 802 in this embodiment comprises an outer tubular body 804 and at least one inner tubular body 806. In FIG. 8A, the outer tubular body 804 is shown as transparent for illustrative purposes to show the inner tubular body 806 and other internal structures. In this embodiment, the outer and inner tubular bodies 804 and 806 are each approximately cylindrical. In other embodiments, the outer and inner tubular bodies 804 and 806 may be any other suitable shape.

The outer tubular body 804 may have an outer wall 803 and an inner wall 805. The inner tubular body 806 may have an outer wall 807 and an inner wall 809. The inner wall 809 of the inner tubular body 806 may define an internal chamber 811. The inner tubular body 806 may be spaced apart from the outer tubular body 804 such that the inner wall 805 of the outer tubular body 804 and the outer wall 807 of the inner tubular body 806 define an annular space 808 therebetween. The outer tubular body 804 may define an inlet 812 and an outlet 814 in fluid communication with the annular space 808.

The outer tubular body 804 may be metallic and may be made of any suitable metal. The outer tubular body 804 may be electrically grounded and may function electrically as the ground electrode. The outer tubular body 804 may also function as a pressure containment shell.

The inner tubular body 806 may be metallic and may be made of any suitable metal. The inner tubular body 806 may function electrically as a live electrode. The electrical heating circuit may be completed by the pressurized, electrically conductive brine flowing through the annular space 808, as described below.

In some embodiments, the ohmic heating device 802 further comprises at least one electrically insulating structural support 810 in the annular space 808 between the outer tubular body 804 and the inner tubular body 806. Each electrically insulating structural support 810 may extend between the inner wall 805 of the outer tubular body 804 and the outer wall 807 of the inner tubular body 806. In some embodiments, each electrically insulating structural support 810 may be made from a high-temperature, non-conducing structural ceramic material, for example alumina- or zirconia-based structural ceramic materials. In other embodiments, each electrically insulating structural support 810 may be made of any other suitable material.

As shown in FIGS. 8A and 8B, in this embodiment, the ohmic heating device 802 comprises a plurality of electrically insulating structural supports 810. In some embodiments, the supports 810 may be longitudinally and/or radially spaced within the annular space 808.

A power cable 816 may extend from outside of the outer tubular body 804, through the outer tubular body 804 and the inner tubular body 806, into the internal chamber 811 and electrically connect to the inner wall 809 of the inner tubular body 806. The power cable 816 may be operatively connected to a power source (not shown). In some embodiments, the power source is an AC (alternating current) power source. Use of alternating current rather than direct current may help to avoid electrode polarization and electrolysis reactions. In other embodiments, the power source is any other suitable power source.

In some embodiments, an electrically insulating bushing 818 may receive the power cable 816 therethrough. The electrically insulating bushing 818 may extend from outside of the outer tubular body 804, through the outer tubular body 804, to the outer wall 807 of the inner tubular body 806. In some embodiments, the electrically insulating bushing 818 is made from high-temperature electrically insulating ceramics or composites comprising high-temperature polymeric materials. In other embodiments, the electrically insulating bushing 818 may be made from any other suitable material.

The porcelain insulators typically used as lead-through bushings in conventional ohmic steam generators are affected by the alkalinity of the water, which should not exceed 400 ppm in conventional systems. Therefore, porcelain insulators may not be suitable for use in the ohmic heating device 802 in which the alkalinity of the concentrated brine may be much higher than this limit. For example, studies on the brine in the blowdown streams from SAGD operations, which may be similar compositionally to that of the concentrated brine flowing through the ohmic heating device 802, indicate that alkalinity can range from 25,000 ppm to 70,000 ppm. Therefore, for electrical lead-through bushings in the ohmic heating device 802, other high temperature electrical insulating materials with good mechanical strength and chemical resistance may be preferred. Non-limiting examples of suitable high-temperature dielectric materials include alumina-based ceramics, zirconia-based ceramics and composites incorporating high temperature polymers.

Referring again to FIG. 8A, the ohmic heating device 802 may operate as follows. A stream F80 of pressurized brine may be received into the annular space 808 via the inlet 812. The stream F80 may be similar to the streams F4 and F11 of FIGS. 1A and 3 as described above. The stream F80 may complete the electrical circuit between the outer tubular body 804 and the inner tubular body 806 and allow the stream F80 to be heated. A stream F82 of heated, pressurized brine may thereby be generated and the stream F82 may exit the annular space 808 via the outlet 814. The stream F82 may be similar to the streams F5 and F12 of FIGS. 1A and 3 as described above. The stream F82 may be directed to a flash vessel (not shown) to undergo flash cooling.

Therefore, in some embodiments, the ohmic heating device 802 is able to heat a stream of pressurized brine by passing an electrical current through the brine itself, thereby avoiding heat transfer surfaces and associated fouling issues. In addition, boiling of the brine is avoided, thereby reducing the risk of damaging electrical arcing.

As one specific example, for the ohmic heating device 802, calculations based on ohmic field heating show that when the radius to the inner wall 805 of the outer tubular body 804 is 60 cm and the radius to the outer wall 807 of the inner tubular body 806 is 50 cm, the power dissipated at 230 V is 29 MW/m of length of vessel for the case of sodium chloride saturated water. In comparison, for pure water, the power dissipated under this condition is only 7 W/m.

Other variations are also possible. In this embodiment, the ohmic heating device 802 is configured to use single-phase AC power. Other embodiments are envisioned in which the ohmic heating device 802 is configured to use three-phase AC power. For example, in some embodiments, the ohmic heating device 802 may comprise three longitudinally spaced apart inner tubular bodies (not shown) within a single outer tubular body (not shown). Each inner tubular body may be similar to the inner tubular body 806 of FIGS. 8A and 8B. The single outer tubular body may be similar to the outer tubular body 804 but with a greater longitudinal length to accommodate the three inner tubular bodies. In this embodiment, current leakage between the inner tubular bodies (i.e. live electrodes) is unlikely to be a concern since it occurs through the brine, which is thereby heated.

Various modifications besides those already described are possible without departing from the concepts disclosed herein. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Although particular embodiments have been shown and described, it will be appreciated by those skilled in the art that various changes and modifications might be made without departing from the scope of the disclosure. The terms and expressions used in the preceding specification have been used herein as terms of description and not of limitation, and there is no intention in the use of such terms and expressions of excluding equivalents of the features shown and described or portions thereof.

The invention claimed is:

1. A method for generating a vapor, the method comprising:

a) providing a vessel operating at a first pressure and a first temperature and having a liquid brine phase therein;

b) introducing a feedstream into the vessel such that the feedstream enters the liquid brine phase, wherein the feedstream contains dissolved solids therein;

c) withdrawing a stream of liquid brine from the liquid brine phase of the vessel, wherein the stream of liquid brine is below its saturation point due to the feedstream combining with the liquid brine phase;

d) pressurizing the stream of liquid brine to a second pressure, the second pressure being higher than the first pressure;

e) heating the pressurized stream of liquid brine from step d) in an ohmic heating device to a second temperature, the second temperature being higher than the first temperature, wherein:

the ohmic heating device comprises an outer tubular body functioning as a ground electrode, at least one inner tubular body functioning as a live electrode, and an annular space defined therebetween;

heating the pressurized stream of liquid brine comprises flowing the pressurized stream of liquid brine through the annular space;

the second temperature and the second pressure are selected to prevent boiling of the pressurized stream of liquid brine as the pressurized stream of liquid brine flows through the ohmic heating device; and the dissolved solids remain dissolved in the pressurized stream of liquid brine as the pressurized stream of liquid brine flows through the ohmic heating device;

f) introducing the pressurized, heated stream of liquid brine from step e) into the vessel via a flash inlet above the liquid brine phase, such that the pressurized, heated stream of liquid brine flashes to a vapor portion and a remaining liquid portion without flashing the liquid brine phase, wherein the remaining liquid portion enters the liquid brine phase; and g) withdrawing a vapor stream from the vessel.

2. The method of claim 1, further comprising repeating steps b) to g) continuously or intermittently.

3. The method of claim 1, further comprising maintaining the liquid brine phase in the vessel at or above a threshold volume.

4. The method of claim 3, further comprising repeating steps c) to g) prior to introducing an additional feedstream at step b).

5. The method of claim 1, further comprising deaerating the feedstream in a deaerator prior to step b).

6. The method of claim 5, further comprising separating the vapor stream into a primary vapor stream and a secondary vapor stream, the secondary vapor stream being at a lower pressure than the primary vapor stream.

7. The method of claim 6, further comprising introducing the secondary vapor stream into the deaerator.

8. The method of claim 5, further comprising withdrawing, from the vessel, a first slurry stream of precipitated solids produced by flashing the pressurized, heated stream of liquid brine at step f).

9. The method of claim 8, further comprising:

providing a secondary vessel having a second liquid brine phase therein and operating at a third pressure and a third temperature, the third pressure and the third temperature being lower than the first pressure and first temperature; and introducing the first slurry stream into the secondary vessel such that the first slurry stream flashes to a second vapor portion and a second remaining liquid portion.

10. The method of claim 9, further comprising withdrawing a second slurry stream from the secondary vessel, the second slurry stream comprising precipitated solids produced by flashing the first slurry stream.

11. The method of claim 9, further comprising withdrawing a second vapor stream from the secondary vessel and introducing the second vapor stream into the deaerator.

12. The method of claim 1, wherein the feedstream comprises at least one of a produced water from a thermal oil recovery process, a brackish water, a sea water, or a process water from a chemical, ore, or biomass processing operation.

13. A system for vaporizing a feedstream containing dissolved solids therein, comprising:

at least one pump to pressurize a stream of liquid brine, wherein the stream of liquid brine comprises liquid brine combined with the feedstream, and the stream of liquid brine is below its saturation point;

at least one ohmic heating device, in fluid communication with the pump, to heat the pressurized stream of liquid brine, wherein:

the ohmic heating device comprises an outer tubular body functioning as a ground electrode, at least one inner tubular body functioning as a live electrode, and an annular space defined therebetween;

the pressurized stream of liquid brine is heated by flowing the pressurized stream of liquid brine through the annular space; and;

the ohmic heating device is operated under a temperature and pressure selected to prevent boiling of the pressurized stream of liquid brine as it flows through the ohmic heating device; and the dissolved solids remain dissolved in the pressurized stream of liquid brine as the pressurized stream of liquid brine flows through the ohmic heating device; and at least one vessel in fluid communication with the at least one ohmic heating device, the at least one vessel comprising a chamber having a liquid brine phase therein, wherein the at least one vessel comprises a flash inlet above the liquid brine phase to introduce the pressurized, heated stream of liquid into the chamber such that the pressurized, heated stream of liquid brine flashes to a vapor portion and a remaining liquid portion without flashing the liquid brine phase, wherein the remaining liquid portion enters the liquid brine phase.

14. The system of claim 13, wherein the at least one ohmic heating device is operatively connected to at least one power source.

15. The system of claim 14, wherein the at least one power source comprises a variably available power source.

16. The system of claim 14, wherein the at least one power source comprises a continuously available power source.

17. The system of claim 13, wherein the at least one vessel comprises a primary vessel and a secondary vessel, the secondary vessel having a lower operating pressure than the primary vessel.

18. The system of claim 13, wherein the at least one inner tubular body comprises one inner tubular body and the at least one ohmic heating device uses single-phase AC power.

19. The system of claim 13, wherein the at least one inner tubular body comprises three inner tubular bodies and the at least one ohmic heating device uses three-phase AC power.

* * * * *